US009756901B2

(12) United States Patent
Musho et al.

(10) Patent No.: US 9,756,901 B2
(45) Date of Patent: Sep. 12, 2017

(54) ARTICLES OF FOOTWEAR COMPRISING A LENO WOVEN UPPER AND METHODS OF MAKING THE SAME

(71) Applicant: adidas AG, Herzogenaurach (DE)

(72) Inventors: Edward John Musho, Portland, OR (US); John Acevedo, Portland, OR (US); Andrea Nieto Perilla, Fulshear, TX (US); Jeffrey William Bruner, Colfax, NC (US); Joseph Michael Davis, Colfax, NC (US); Leslie Allison Whittle, Colfax, NC (US)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 14/793,438

(22) Filed: Jul. 7, 2015

(65) Prior Publication Data

US 2017/0006965 A1 Jan. 12, 2017

(51) Int. Cl.

| | |
|---|---|
| ***A43B 23/02*** | (2006.01) |
| ***A43B 1/00*** | (2006.01) |
| ***A43B 1/04*** | (2006.01) |
| ***A43B 7/08*** | (2006.01) |
| ***A43B 23/08*** | (2006.01) |

(Continued)

(52) U.S. Cl.

CPC ..... *A43B 23/0205* (2013.01); *A43B 1/0009* (2013.01); *A43B 1/0045* (2013.01); *A43B 1/04* (2013.01); *A43B 7/06* (2013.01); *A43B 7/085* (2013.01); *A43B 23/0265* (2013.01); *A43B 23/0295* (2013.01); *A43B 23/088* (2013.01); *A43C 5/00* (2013.01); *D03D 1/00* (2013.01);

(Continued)

(58) Field of Classification Search

CPC .. A43B 1/02; A43B 1/04; A43B 23/00; A43B 23/04; A43B 23/0205

USPC ..... 36/45, 47, 48, 9 R

See application file for complete search history.

(56) References Cited

U.S. PATENT DOCUMENTS 2,069,295 A * 2/1937 Wilson ..... D03D 15/08 139/419

2,147,197 A 2/1939 Glidden (Continued)

FOREIGN PATENT DOCUMENTS

CN 101324001 7/2008

CN 103451769 12/2013

(Continued)

OTHER PUBLICATIONS

Extended European Search Report issued in European Patent Application No. 16176607.6 on Dec. 9, 2016, 12 pages.

(Continued)

*Primary Examiner* — Marie Bays

(74) *Attorney, Agent, or Firm* — Sterne, Kessler, Goldstein & Fox P.L.L.C.

(57) ABSTRACT

An article of footwear having an upper comprising leno woven fabric. The leno woven fabric may be a single layer leno woven fabric. The leno woven fabric may have a pattern to provide desired characteristics, such as but not limited to, ventilation, thermal conductivity, stretchability, strength, moisture wicking, and/or antimicrobial protection. The pattern may be non-uniform to provide varying degrees of one or more of these characteristics. Methods for manufacturing an article of footwear including an upper comprising leno woven fabric are also provided.

20 Claims, 18 Drawing Sheets

(51) Int. Cl.

| | |
|---|---|
| ***A43C 5/00*** | (2006.01) |
| ***D03D 1/00*** | (2006.01) |
| ***D03D 19/00*** | (2006.01) |
| ***A43B 7/06*** | (2006.01) |

(52) U.S. Cl.
CPC ..... *D03D 19/00* (2013.01); *D10B 2501/043* (2013.01)

(56) References Cited

U.S. PATENT DOCUMENTS

| | | | | |
|---|---|---|---|---|
| 2,314,098 | A | 3/1943 | McDonald | |
| 2,500,668 | A * | 3/1950 | Duckoff | A43C 11/006 139/422 |
| 3,524,792 | A | 8/1970 | Dawes | |
| 3,822,727 | A * | 7/1974 | Small | D03D 11/02 139/383 R |
| 4,144,727 | A | 3/1979 | Duhl et al. | |
| 4,736,531 | A | 4/1988 | Richard | |
| 4,785,558 | A | 11/1988 | Shiomura | |
| 5,131,434 | A * | 7/1992 | Krummheuer | D03D 1/02 139/116.1 |
| 5,187,005 | A | 2/1993 | Stahle et al. | |
| 5,345,638 | A | 9/1994 | Nishida | |
| 5,384,973 | A | 1/1995 | Lyden | |
| 5,484,646 | A | 1/1996 | Mann | |
| 5,562,967 | A * | 10/1996 | Kikuchi | D03D 9/00 139/383 R |
| 6,004,891 | A | 12/1999 | Tuppin et al. | |
| 6,029,376 | A | 2/2000 | Cass | |
| D447,637 | S | 9/2001 | Lacy et al. | |
| 6,435,221 | B1 * | 8/2002 | Waldrop | D03D 15/08 139/383 R |
| D477,918 | S | 8/2003 | Bruner et al. | |
| D477,919 | S | 8/2003 | Bruner et al. | |
| 6,684,911 | B2 * | 2/2004 | Salway | D03D 19/00 139/383 A |
| 6,786,242 | B2 * | 9/2004 | Salway | D03D 19/00 139/383 A |
| 6,931,762 | B1 | 8/2005 | Dua | |
| 7,047,668 | B2 | 5/2006 | Burris et al. | |
| 7,107,235 | B2 | 9/2006 | Lyden | |
| D531,817 | S | 11/2006 | Bruner et al. | |
| 7,166,349 | B2 * | 1/2007 | Collins | D04H 3/045 139/383 A |
| D557,509 | S | 12/2007 | Davis et al. | |
| 7,721,575 | B2 | 5/2010 | Yokoyama | |
| 7,766,053 | B2 * | 8/2010 | Barratte | D21F 1/0036 139/383 A |
| 7,841,107 | B2 | 11/2010 | Braynock et al. | |
| 7,950,676 | B2 * | 5/2011 | Goldsmith | A43B 5/1625 280/11.12 |
| D664,365 | S | 7/2012 | Whittle et al. | |
| D664,366 | S | 7/2012 | Whittle et al. | |
| D664,367 | S | 7/2012 | Whittle et al. | |
| D664,368 | S | 7/2012 | Davis | |
| 8,209,883 | B2 | 7/2012 | Lyden | |
| 8,375,471 | B2 | 2/2013 | Surve | |
| 8,910,313 | B2 | 12/2014 | Gorden et al. | |
| 2003/0069807 | A1 | 4/2003 | Lyden | |
| 2003/0089000 | A1 * | 5/2003 | Tseng | A43B 1/00 36/45 |
| 2003/0172983 | A1 * | 9/2003 | Salway | D03D 19/00 139/57 |
| 2004/0033337 | A1 * | 2/2004 | Collins | D04H 3/045 428/105 |
| 2005/0116379 | A1 * | 6/2005 | Goldsmith | A43B 5/1625 264/222 |
| 2009/0119948 | A1 * | 5/2009 | Ortley | A43B 5/001 36/84 |
| 2009/0291603 | A1 | 11/2009 | Newton et al. | |
| 2010/0223808 | A1 * | 9/2010 | Sandy | A43B 3/101 36/10 |
| 2011/0119963 | A1 | 5/2011 | Braynock et al. | |
| 2011/0258881 | A1 * | 10/2011 | Mateo | A43B 5/00 36/114 |
| 2011/0308115 | A1 | 12/2011 | Le et al. | |
| 2013/0025157 | A1 | 1/2013 | Wan et al. | |
| 2013/0048140 | A1 * | 2/2013 | Yenici | D03D 15/04 139/422 |
| 2013/0055590 | A1 * | 3/2013 | Mokos | A43B 1/04 36/45 |
| 2013/0190917 | A1 | 7/2013 | Cross et al. | |
| 2014/0173932 | A1 * | 6/2014 | Bell | A43B 1/04 36/84 |
| 2014/0173933 | A1 * | 6/2014 | Bell | A43B 1/04 36/84 |
| 2014/0173934 | A1 | 6/2014 | Bell | |
| 2014/0189964 | A1 * | 7/2014 | Wen | A43B 23/021 12/142 R |
| 2014/0259760 | A1 | 9/2014 | Dojan et al. | |
| 2014/0273700 | A1 | 9/2014 | Mouhassin et al. | |
| 2014/0310984 | A1 | 10/2014 | Tamm et al. | |
| 2014/0338222 | A1 * | 11/2014 | Song | A43B 23/0235 36/45 |
| 2015/0013187 | A1 * | 1/2015 | Taniguchi | A43B 1/04 36/84 |
| 2015/0201707 | A1 * | 7/2015 | Bruce | A43B 23/0235 36/47 |
| 2015/0218737 | A1 * | 8/2015 | Blakely | D03D 15/06 428/131 |
| 2016/0081417 | A1 * | 3/2016 | Podhajny | D04B 1/123 36/9 R |
| 2016/0095377 | A1 * | 4/2016 | Tamm | A43B 3/0036 36/9 R |
| 2016/0309843 | A1 | 10/2016 | Song et al. | |

FOREIGN PATENT DOCUMENTS

| | | | |
|---|---|---|---|
| CN | 203482955 | U | 3/2014 |
| DE | 10307489 | B3 | 11/2004 |
| DE | 102013214598 | A1 | 1/2015 |
| EP | 0600331 | A1 | 6/1994 |
| JP | H6113905 | | 4/1994 |
| KR | 10-1557130 | B1 | 9/2015 |
| TW | D122133 | | 4/2008 |
| TW | D125241 | | 10/2008 |
| TW | D138821 | | 2/2011 |
| TW | D141585 | | 7/2011 |
| TW | D141586 | | 7/2011 |
| WO | WO-96-00512 | | 1/1996 |
| WO | WO-98-43506 | | 3/1998 |
| WO | WO-2013-071679 | | 5/2013 |
| WO | WO-2013-103363 | | 7/2013 |
| WO | 2016171304 | A1 | 10/2016 |

OTHER PUBLICATIONS

Shinn et, W.E. et al. "Leno Weaving and Design" Sep. 1930, 6 pages.

* cited by examiner

ARTICLES OF FOOTWEAR COMPRISING A LENO WOVEN UPPER AND METHODS OF MAKING THE SAME

FIELD

The described embodiments generally relate to articles of footwear having an upper comprising leno woven fabric. In particular, described embodiments relate to articles of footwear having an upper comprising a single layer leno woven fabric.

BACKGROUND

Individuals are often concerned with the durability, weight, and/or breathability of an article of footwear. This is true for articles of footwear worn for non-performance activities, such as a leisurely stroll, and for performance activities, such as running. Durable footwear will properly function for an extended period of time. Lightweight footwear minimizes the weight an individual has to carry on his or her feet and may be comfortable for an individual. Breathable footwear may increase comfort for an individual by wicking sweat and heat away from an individual's foot.

Proper footwear should be durable, comfortable, and provide other beneficial characteristics for an individual. Therefore, a continuing need exists for innovations in footwear and fabrics used to manufacture the footwear.

BRIEF SUMMARY OF THE INVENTION

Some embodiments are directed towards an article of footwear including a sole, an upper coupled to the sole, the upper including a single layer woven fabric having a leno weave configuration with a plurality of weft yarns extending in a longitudinal direction from a forefoot portion of the article of footwear towards a heel portion of the article of footwear and a plurality of warp yarns extending in a transverse direction substantially perpendicular to the warp yarns.

In some embodiment, the single layer woven fabric may be directly coupled to the sole. In some embodiments, the single layer woven fabric may include a continuous portion extending from the forefoot portion of the article of footwear to a midfoot portion of the article of footwear. In some embodiments, the single layer woven fabric may include a continuous portion extending from the forefoot portion of the article of footwear to the heel portion of the article of footwear. In some embodiments, the single layer woven fabric may include a continuous portion extending from a lateral side of the article of footwear to a medial side of the article of footwear.

In some embodiments, one or more of the warp yarns includes a first end directly coupled to the sole and a second end directly coupled to the sole. In some embodiments, one or more of the warp yarns includes a first end directly coupled to a lateral side of the sole and a second end directly coupled to a medial side of the sole In some embodiments, the single layer woven fabric may define at least 50% of the upper.

In some embodiments, the weft yarns may include at least one of: a moisture wicking yarn, an antibacterial yarn, a thermally conductive yarn, and a combination thereof.

In some embodiments, the leno weave configuration includes a non-uniform pattern. In some embodiments, the leno weave configuration includes a non-uniform honeycomb pattern.

In some embodiments, the weft yarns may be arranged in sets of at least two yarns arranged side-by-side along at least a portion of the upper. In some embodiments, the set of weft yarns may split at one or more points on the upper to provide at least one of: ventilation for the upper and directional stretchability for the upper.

In some embodiments, the upper may include a first portion including the single layer woven fabric and a second portion comprising a heel counter, an ankle cuff, and a tongue. In some embodiments, one or more weft yarns includes a first end coupled to the second portion and a second end coupled to the sole of the article of footwear.

In some embodiments, the single layer woven fabric may be a continuous layer having varying degrees of at least one of: ventilation, thermal conductivity, stretchability, strength, moisture wicking, and antimicrobial protection.

Some embodiments are directed towards an article of footwear including a sole, an upper coupled to the sole, the upper including a leno woven fabric having a plurality of weft yarns extending in a substantially longitudinal direction from a forefoot portion of the article of footwear towards a heel portion of the article of footwear and a plurality of warp yarns extending in a transverse direction substantially perpendicular to the warp yarns, the leno woven fabric defining at least 50% of the upper.

In some embodiments, the leno woven fabric may occupy at least 50% of the outer surface area of the upper. In some embodiments, the leno woven fabric may be directly coupled to the sole.

Some embodiments are directed towards a method of manufacturing an article of footwear, the method including coupling a single layer woven fabric having a leno weave to a footwear component comprising a heel counter, coupling the single layer woven fabric to a sole, and coupling the heel counter to the sole.

BRIEF DESCRIPTION OF THE DRAWINGS/FIGURES

Figures 14A, 14B, 14C:
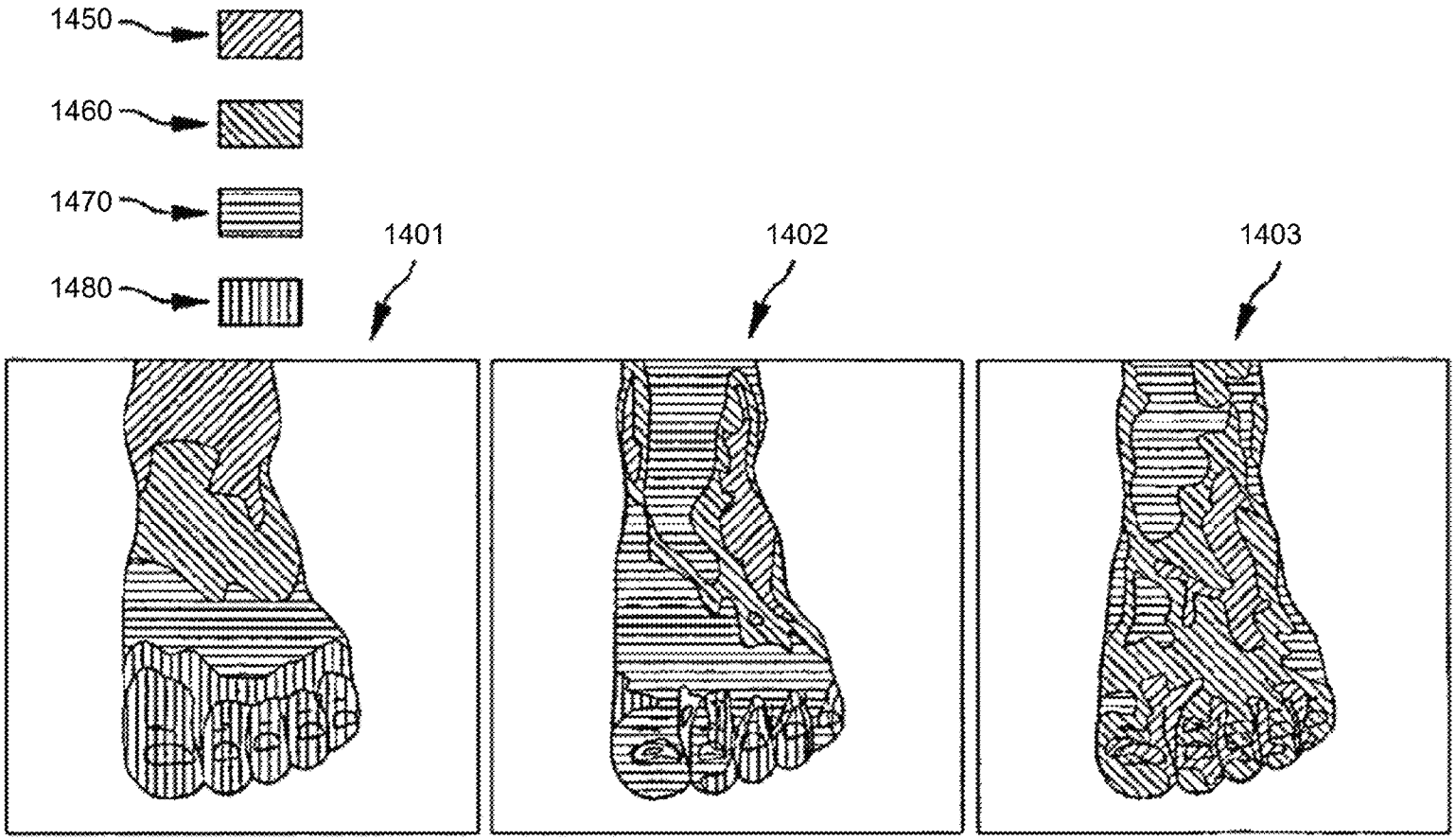

FIGS. 14A, 14B, and 14C illustrate perspective views of a foot with exemplary skin temperatures according to an embodiment.

Figure 15C:
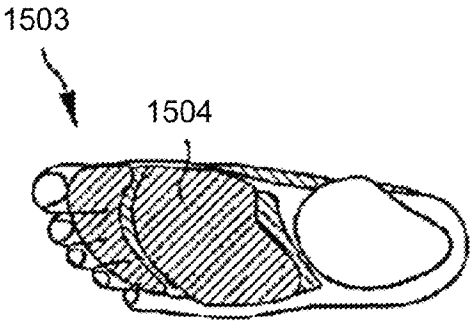
Figure 15B:
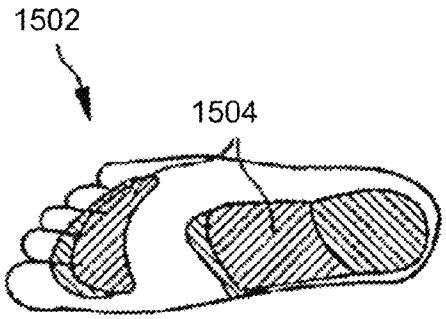
Figure 15A:
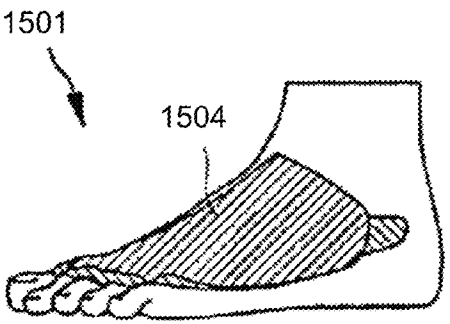

FIGS. 15A, 15B, and 15C illustrate areas of exemplary sweat production of a foot according to an embodiment.

Figures 16A, 16B, 16C:
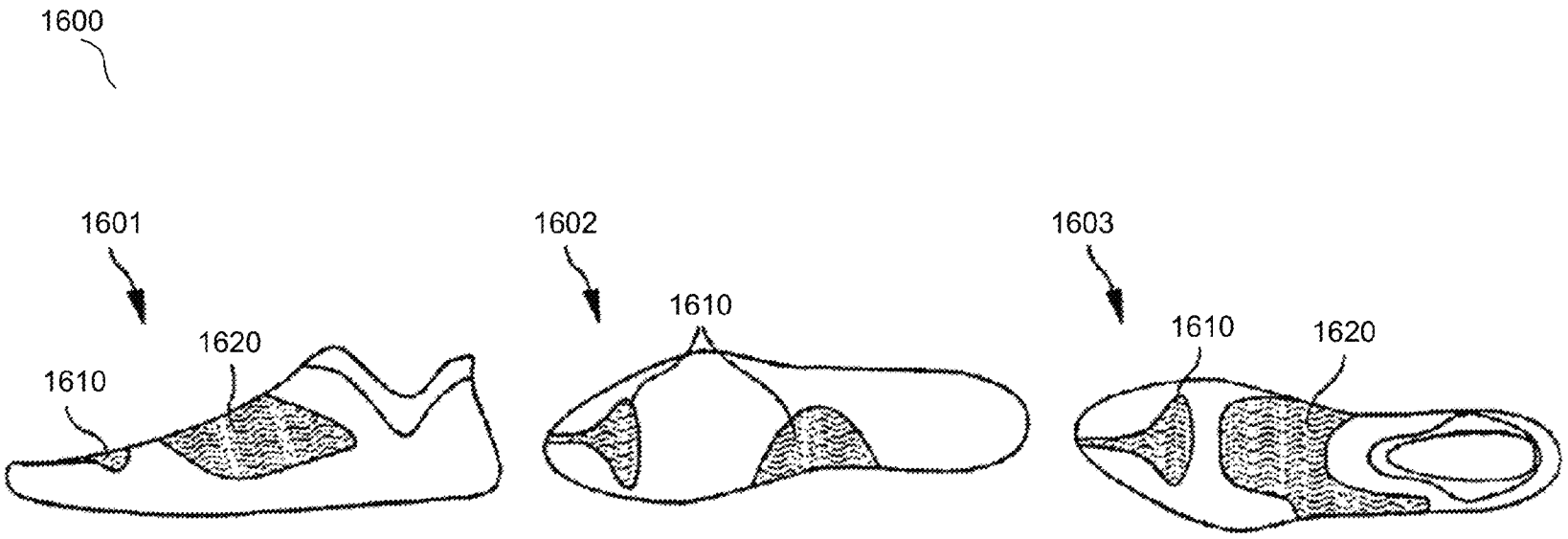

FIGS. 16A, 16B, and 16C are a side view, bottom view, and a top view of a sock with first and second zones according to an embodiment.

Figure 17A:
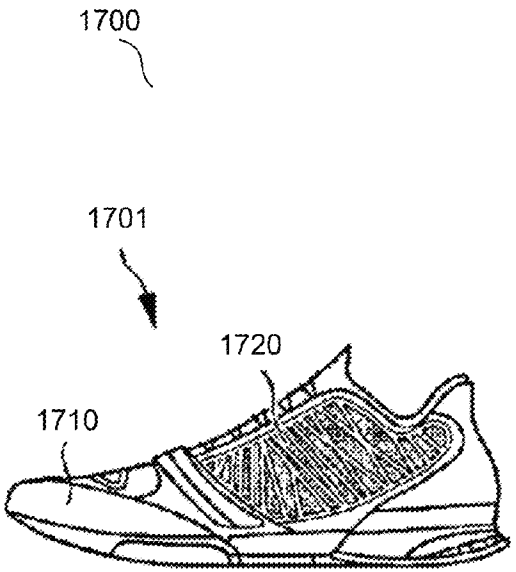
Figure 17B:
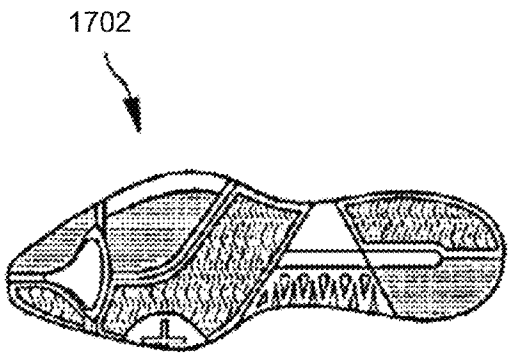
Figure 17C:
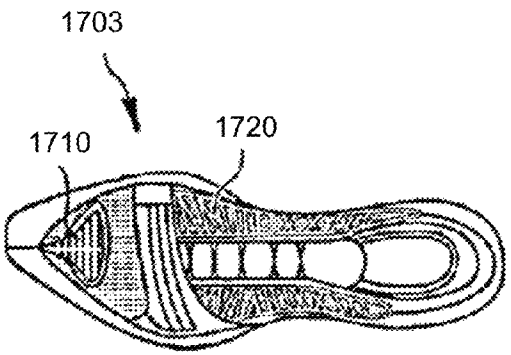

FIGS. 17A, 17B, and 17C are a side view, bottom view, and a top view of a shoe with first and second zones according to an embodiment.

Figure 18C:
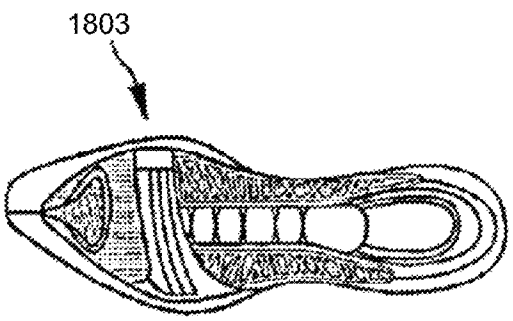
Figure 18B:
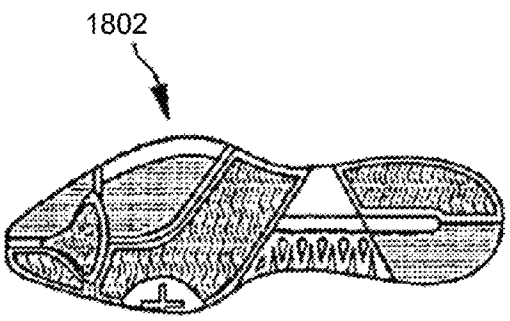
Figure 18A:
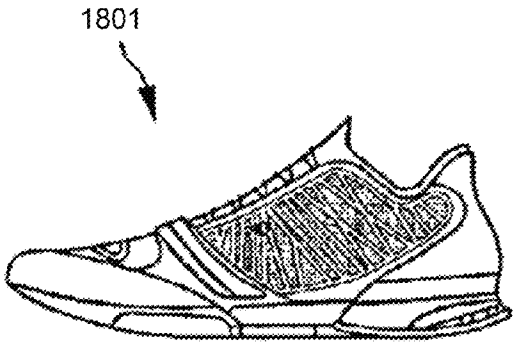

FIGS. 18A, 18B, and 18C are a side view, bottom view, and a top view of a combined system of a sock and shoe with first and second zones according to an embodiment.

DETAILED DESCRIPTION OF THE INVENTION

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

An article of footwear has many purposes. Among other things, an article of footwear may serve to provide cushioning for a wearer's foot, support a wearer's foot, and protect a wearer's foot. Each of these purposes, alone or in combination, provides for a comfortable article of footwear suitable for use in a variety of scenarios (e.g., exercise and every day activities). The features of an article of footwear (e.g., shape and materials used to make footwear) may be altered to produce desired characteristics, for example, durability, weight, and/or breathability.

Durable footwear will properly function for an extended period of time and may instill a wearer's trust in specific manufacture's footwear, leading to repeat sales. Lightweight footwear may be conformable for an individual and, for individual's competing in an athletic activity, such as running or biking, may provide a completive edge due to the decreased weight the individual carries on his or her foot. Breathable footwear may increase comfort for an individual by wicking sweet and heat away from an individual's foot. Designing footwear having a high degree of one or more of these characteristics without detrimentally affecting other characteristics of the footwear may be desirable.

An article of footwear, or a portion thereof (e.g., an upper), may be configured to provide various degrees of durability, weight, breathability, etc. But the cost of manufacturing the article of footwear may also be a consideration. Footwear, or a portion thereof, that may be manufactured at a relatively low cost may be desirable for manufactures and consumers. Footwear that can be manufactured using a relatively small amount of resources (e.g., energy and man power), materials, and time reduces manufacturing costs and may also reduce the environmental impact of manufacturing.

In some embodiments, the article of footwear discussed herein may include a highly breathable upper comprising a fabric with a leno weave (i.e., a leno woven fabric). In some embodiments, the upper may comprise a single layer leno woven fabric. A leno weave construction facilitates breathability of the upper while maintaining the integrity of the overall footwear construction. The structural integrity of a leno weave configuration is produced by the weaving of weft yarns and warp yarns in the leno weave. The use of a leno weave provides adequate structural integrity while reducing time and cost of materials and manufacturing.

The leno woven fabric may include a specific pattern (or composition of different patterns) to provide desired characteristics, such as but not limited to, ventilation, thermal conductivity, stretchability, strength, moisture wicking, and/or antimicrobial protection. The pattern may be non-uniform to provide varying degrees of one or more of these characteristics to a particular area or areas of the upper. In some embodiments, different types of weft yarns and/or warp yarns may be utilized to give the article of footwear different desirable properties (e.g., desired stretchability, breathability, antimicrobial (e.g., antibacterial) protection, thermal conductivity, moisture wicking, etc.). In some embodiments, the weft yarns in the leno weave facilitate moisture wicking, antimicrobial protection, and/or thermal conductivity. In some embodiments, the warp yarns in the leno weave facilitate moisture wicking, antimicrobial protection, and/or thermal conductivity. In some embodiments, the leno woven fabric may provide at least one of: targeted zonal moisture wicking, targeted thermal conductivity, antimicrobial protection, and desired stretchability. Data shows that providing targeted comfort to the forefoot region improves overall performance and comfort of the wearer's foot. In some embodiments, the pattern of the leno weave may work in concert with one or more types of weft yarns and/or warp yarns to provide desired characteristics.

In some embodiments, the weft yarns in a forefoot region of an article of footwear may facilitate at least one of moisture transport and/or wicking, antimicrobial protection, and thermal conductivity from the forefoot region to a midfoot region, thereby improving foot performance and comfort for the wearer. In some embodiments, different regions of the article of footwear, or different locations within different regions, may be customized to provide desired characteristics for a wearer. Moreover, a leno weave may be customized for a specific use (e.g., competitive athletics or causal exercise).

Figure 1:
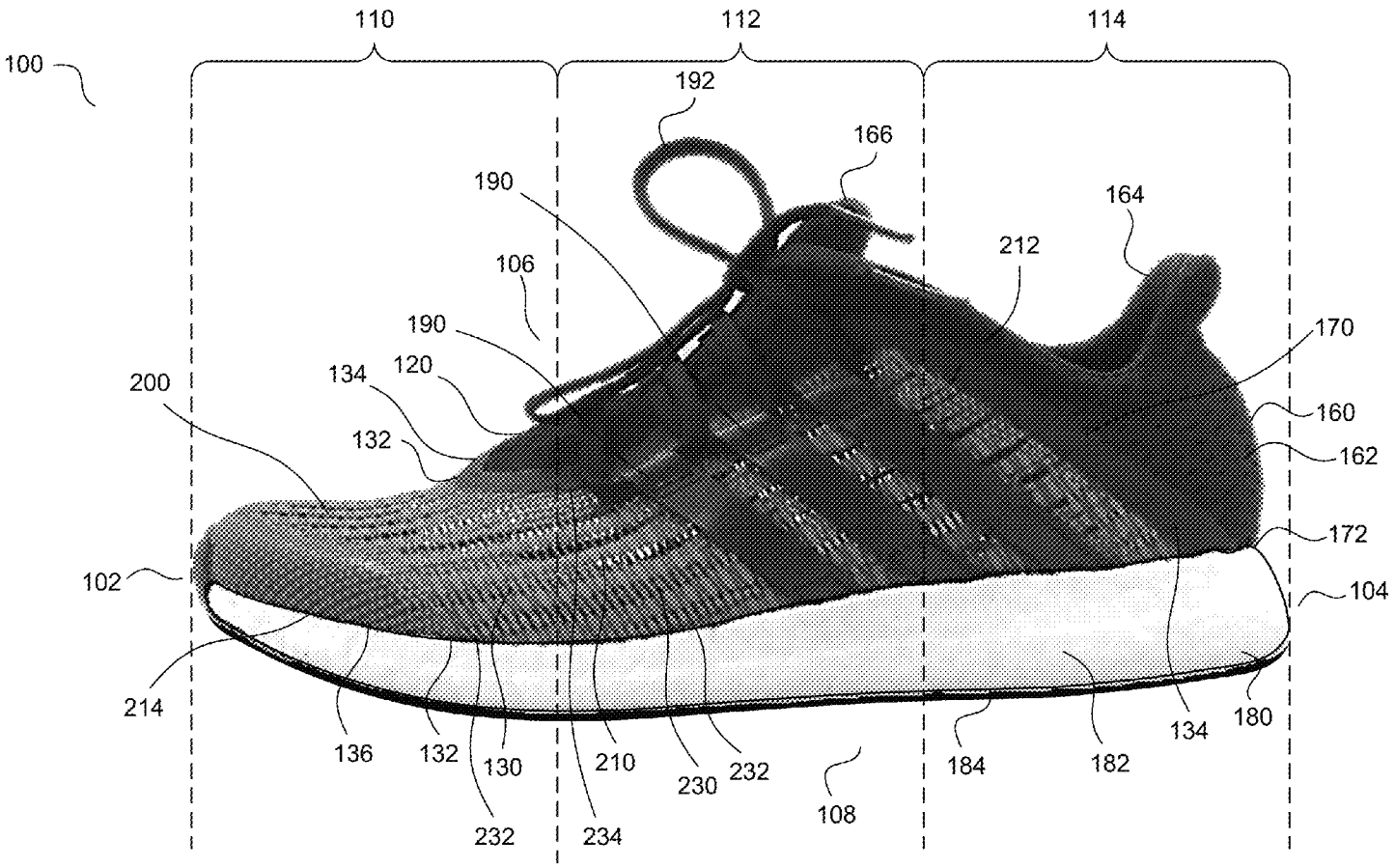
FIG. 1 is a lateral side view of an article of footwear according to an embodiment.

FIG. 1 shows an article of footwear 100 according to an embodiment. Article of footwear 100 may include an upper 120 coupled to a sole 180. As shown in FIG. 1, article of footwear 100 includes a forefoot end 102, a heel end 104, a medial side 106, and a lateral side 108 opposite medial side 106. Also as shown in FIG. 1, article of footwear 100 includes a forefoot portion 110, a midfoot portion 112, and a heel portion 114. Portions 110, 112, and 114 are not intended to demarcate precise areas of article of footwear 100. Rather, portions 110, 112, and 114 are intended to represent general areas of article of footwear 100 that provide a frame of reference. Although portions 110, 112, and 114 apply generally to article of footwear 100, references to portions 110, 112, and 114 also may apply specifically to upper 120 or sole 180, or individual components of upper 120 or sole 180. When article of footwear 100 is assembled, upper 120 may be coupled to sole 180.

Upper 120 may include a first portion 130 and a second portion 160. In some embodiments, first portion 130 may extend from forefoot end 102 to heel portion 114 of article of footwear 100. First portion 130 may be coupled to sole 180. In some embodiments, first portion 130 may be coupled to sole 180 along at least a portion of a border 132 of first portion 130 at a sole connection area 136. First portion 130 may be coupled to sole 180 via for example, but not limited to, adhesive bonding, stitching, lamination (e.g., high frequency welding or heat welding), or a combination thereof. First portion 130 may be coupled to second portion 160. In some embodiments, first portion 130 may be coupled to second portion 160 along at least a portion of border 132 at an upper connection area 134. First portion 130 may be coupled to second portion 160 via for example, but not limited to, adhesive bonding, stitching, lamination (e.g., high frequency welding or heat welding), or a combination thereof. In some embodiments, lamination, such as high frequency welding may be employed to create a desired shape for upper 120. As a non-limiting example, the toe box section of upper 120 may include a laminated area for providing a rounded shape at forefoot end 102 of article of footwear 100. In some embodiments, first portion 130 may be coupled to sole 180 at locations other than or in addition to border 132.

In some embodiments, second portion 160 may extend from heel end 104 to forefoot portion 110 of article of footwear 100. In some embodiments, second portion 160 may be padded (i.e., cushioned) to provide comfort. In some embodiments, second portion 160 may include a heel counter 162, an ankle cuff 164, and a tongue 166. Second portion 160 may be coupled to sole 180. In some embodiments, second portion 160 may be coupled to sole 180 along at least a portion of a border 170 of second portion 160 at a sole connection area 172. In some embodiments, second portion 160 may be coupled to sole 180 at locations other than or in addition to sole connection area 172. Second portion 160 may be coupled to sole 180 via for example, but not limited to, adhesive bonding, stitching, lamination (e.g., high frequency welding or heat welding), or a combination thereof. In some embodiments, second portion 160 may be coupled to first portion 130 along at least a portion of border 170 at upper connection area 134 via for example, but not limited to, adhesive bonding, stitching, lamination (e.g., high frequency welding or heat welding), or a combination thereof. In some embodiments, second portion 160 may be composed of a different fabric, or combination of fabrics, than first portion 130. In some embodiments, second portion 160 may comprise neoprene. In some embodiments, heel counter 162 may comprise neoprene.

Upper 120 may also include one or more eye stays 190 for securing and tensioning a shoe lace 192. While FIG. 1 shows eyes stays 190 secured to and located on first portion 130, eye stays 190 may alternatively or additionally be secured to and/or located on second portion 160. In some embodiments, eye stays 190 may be laminated to first portion 130 and/or second portion 160. In some embodiments, eye stays 190 may be formed by the fabric of first portion 130 and/or second portion 160.

In some embodiments, sole 180 may include a midsole 182 coupled to an outsole 184. Upper 120 and sole 180 may be configured for a specific type of footwear, including, but not limited to, a running shoe, a hiking shoe, a water shoe, a training shoe, a fitness shoe, a dancing shoe, a biking shoe, a tennis shoe, a cleat (e.g., a baseball cleat, a soccer cleat, or a football cleat), a basketball shoe, a boot, a walking shoe, a casual shoe, or a dress shoe. Moreover, sole 180 may be sized and shaped to provide a desired combination of cushioning, stability, and ride characteristics to article of footwear 100. The term "ride" may be used herein in describing some embodiments as an indication of the sense of smoothness or flow occurring during a gait cycle including heel strike, midfoot stance, toe off, and the transitions between these stages. In some embodiments, sole 180 may provide particular ride features including, but not limited to, appropriate control of pronation and supination, support of natural movement, support of unconstrained or less constrained movement, appropriate management of rates of change and transition, and combinations thereof.

Sole 180 and portions thereof (e.g., midsole 182 and outsole 184) may comprise material(s) for providing desired cushioning, ride, and stability. Suitable materials for sole 180 (e.g., midsole 182 and/or outsole 184) include, but are not limited to, a foam, a rubber, ethyl vinyl acetate (EVA), expanded Thermoplastic polyurethane (eTPU), Thermoplastic rubber (TPR) and a thermoplastic polyurethane (PU). In some embodiments, the foam may comprise, for example, an EVA based foam or a PU based foam and the foam may be an open-cell foam or a closed-cell foam. In some embodiments, midsole 182 and/or outsole 184 may comprise elastomers, thermoplastic elastomers (TPE), foam-like plastics, and gel-like plastics.

In some embodiments, portions of sole 180 (e.g., midsole 182 and outsole 184) may comprise different materials to provide different characteristics to different portions of sole 180. In some embodiments, midsole 182 and outsole 184 may have different hardness characteristics. In some embodiments, the material density of midsole 182 and outsole 184 may be different. In some embodiments, the moduli of the materials used to make midsole 182 and outsole 184 may be different. As a non-limiting example, the material of outsole 184 may have a higher modulus than the material of midsole 182.

Sole 180 and portions thereof (e.g., midsole 182 and outsole 184) may be formed using suitable techniques, including, but not limited to, injection molding, blow molding, compression molding, and rotational molding. In some embodiments, midsole 182 and outsole 184 may be discrete components that are formed separately and attached. In some embodiments, midsole 182 may be attached to outsole 184 via, for example, but not limited to, adhesive bonding, stitching, welding, or a combination thereof. In some embodiments, midsole 182 may be attached to outsole 184 via an adhesive disposed between midsole 182 and outsole 184.

Figure 3:
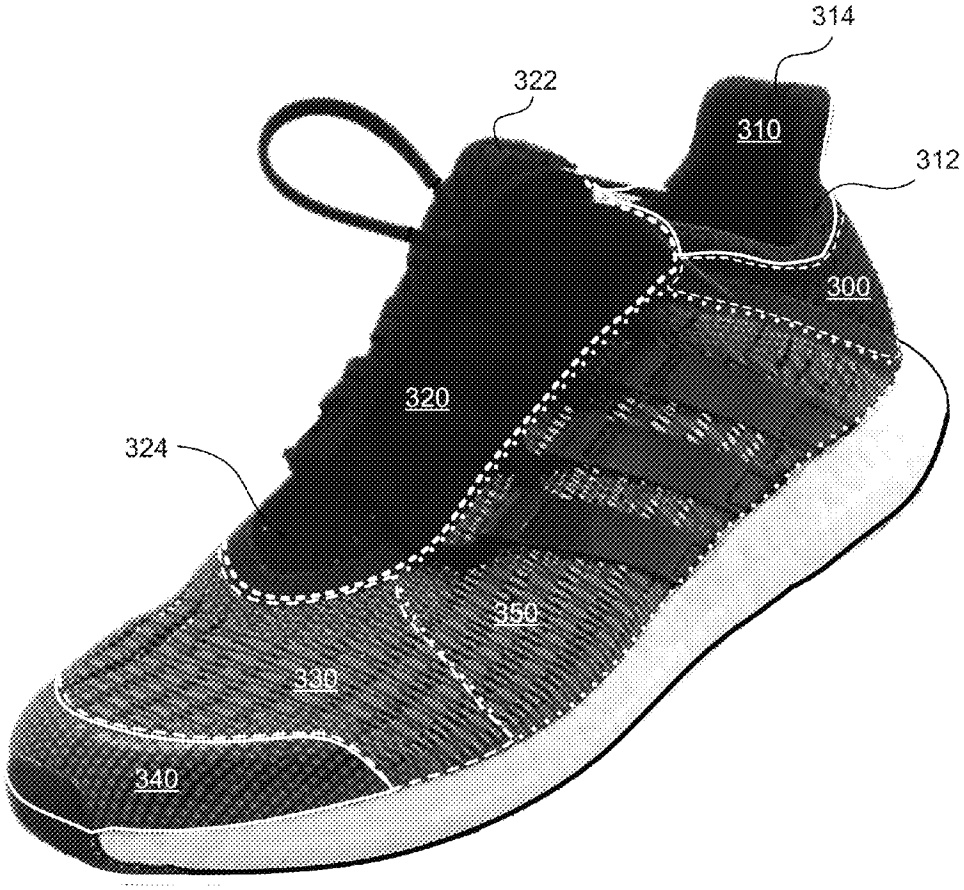
FIG. 3 is a perspective view of an article of footwear according to an embodiment showing different sections of the article of footwear.

As shown in FIG. 3, upper 120 of article of footwear 100 may include various sections, including but not limited to, a heel counter 300, an ankle cuff 310 (which may include a collar 312 and an Achilles heel protector 314), a dorsal section 320 (which may include a tongue 322 and a throat 324), a vamp section 330, a toe box section 340, and quarter sections 350. One quarter section 350 may be located on medial side 106 of article of footwear 100 and the other quarter section 350 is located on lateral side 108 of article of footwear 100. Dorsal section 320 may include a conventional tongue or may be "tongue-less". Sections 300, 310, 320, 330, 340, and 350 are not intended to demarcate precise areas of upper 120. Rather, sections 300, 310, 320, 330, 340, and 350 are intended to represent general areas of upper 120 that provide a frame of reference in the context of the present application.

First portion 130 may define all or a portion of heel counter 300, ankle cuff 310, dorsal section 320, vamp section 330, toe box section 340, and/or quarter section(s) 350 of upper 120. In some embodiments, first portion 130 may define all or a portion of vamp section 330, toe box section 340, and quarter sections 350 of upper 120. Second portion 160 may define all or a portion of heel counter 300, ankle cuff 310, dorsal section 320, vamp section 330, toe box section 340, and/or quarter section(s) 350 of upper 120. In some embodiments, second portion 160 may define all or a portion of heel counter 300, ankle cuff 310, and dorsal section 320 of upper 120.

Figure 2:
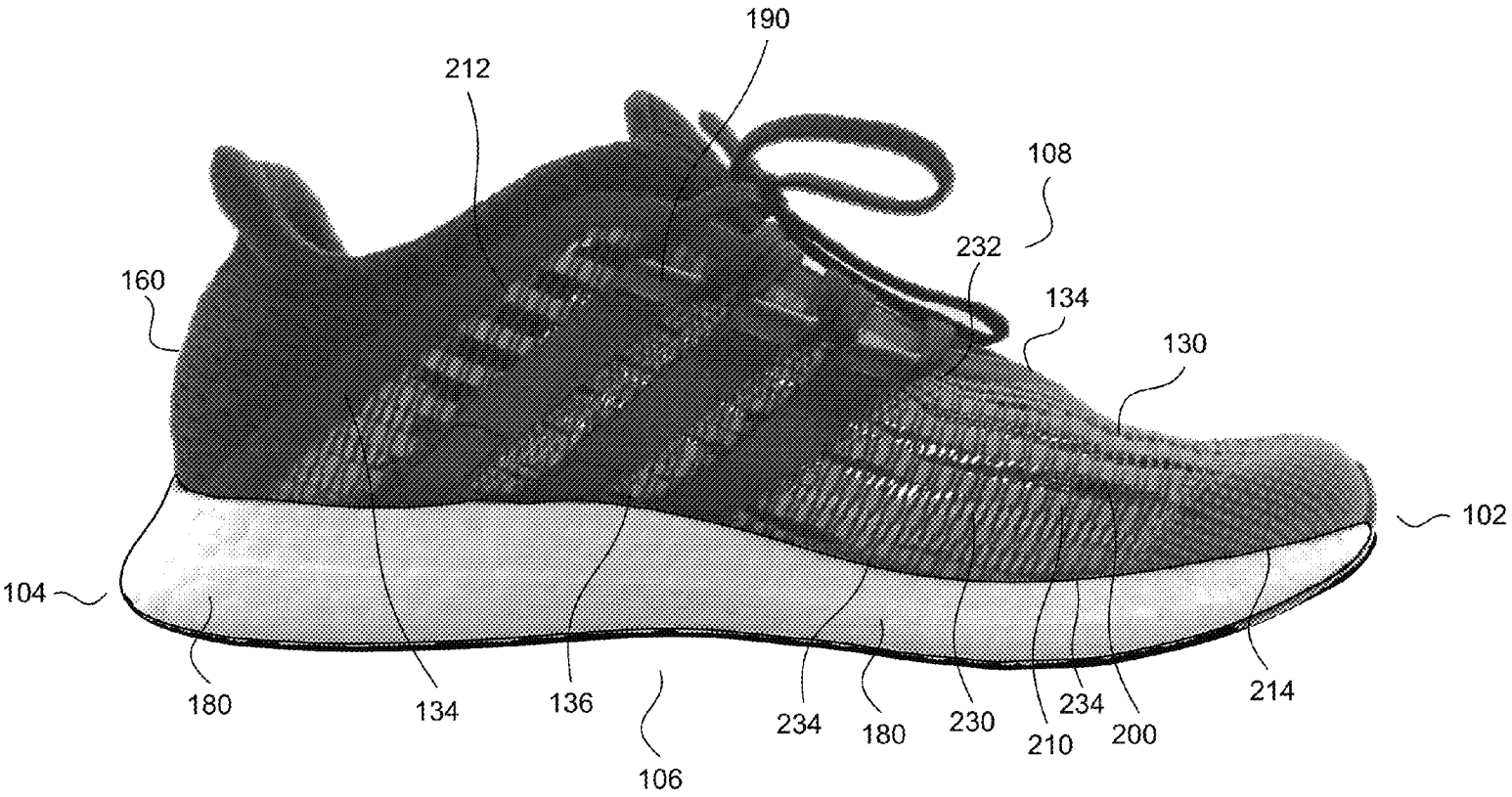
FIG. 2 is a medial side view of an article of footwear according to an embodiment.

Returning now to FIGS. 1 and 2, upper 120 comprises a leno woven fabric 200. All or a portion of upper 120 may comprise a leno woven fabric 200. In some embodiments, leno woven fabric 200 may be a single layer woven fabric. In some embodiments, leno woven fabric 200 may include more than one layer. For example, leno woven fabric 200 may include a textile layer coupled to and reinforced, in whole or in part, with a leno woven layer.

In some embodiments, first portion 130 may include a leno woven fabric 200. In some embodiments, second portion 160 may include leno woven fabric 200. In some embodiments, both first portion 130 and second portion 160 may include leno woven fabric 200. In some embodiments, first portion 130 may consist of leno woven fabric 200. In other words, in some embodiments, first portion 130 may be made only and entirely of leno woven fabric 200. In some embodiments, first portion 130 may comprise a partial foot or full foot bootie. In this manner, upper 120 may be formed without seams. In one embodiment, upper 120 comprises only a first portion 130 having a leno weave and a heel counter 162.

In some embodiments, leno woven fabric 200 may define at least 50% of upper 120. In embodiments including a single layer leno woven fabric 200, single layer woven fabric 200 may completely define at least 50% of upper 120. In other words, at least 50% of the composition of upper 120 may be defined by single layer leno woven fabric 200. In some embodiments, leno woven fabric 200 may occupy at least 50% of the outer surface area of upper 120.

Leno woven fabric 200 may provide one or more of breathability, stretchability, and strength for upper 120. Additional characteristics leno woven fabric 200 may provide include, but are not limited to, thermal conductivity, moisture wicking, and antimicrobial protection. In some embodiments, leno woven fabric 200 may include a leno weave configuration for providing breathability and/or other characteristics. In some embodiments, leno woven fabric 200 may include a leno weave configuration having a pattern configured to provide breathability and/or other characteristics. In some embodiments, the leno weave configuration may have a non-uniform pattern configured to provide breathability and/or other characteristics.

Figure 4:
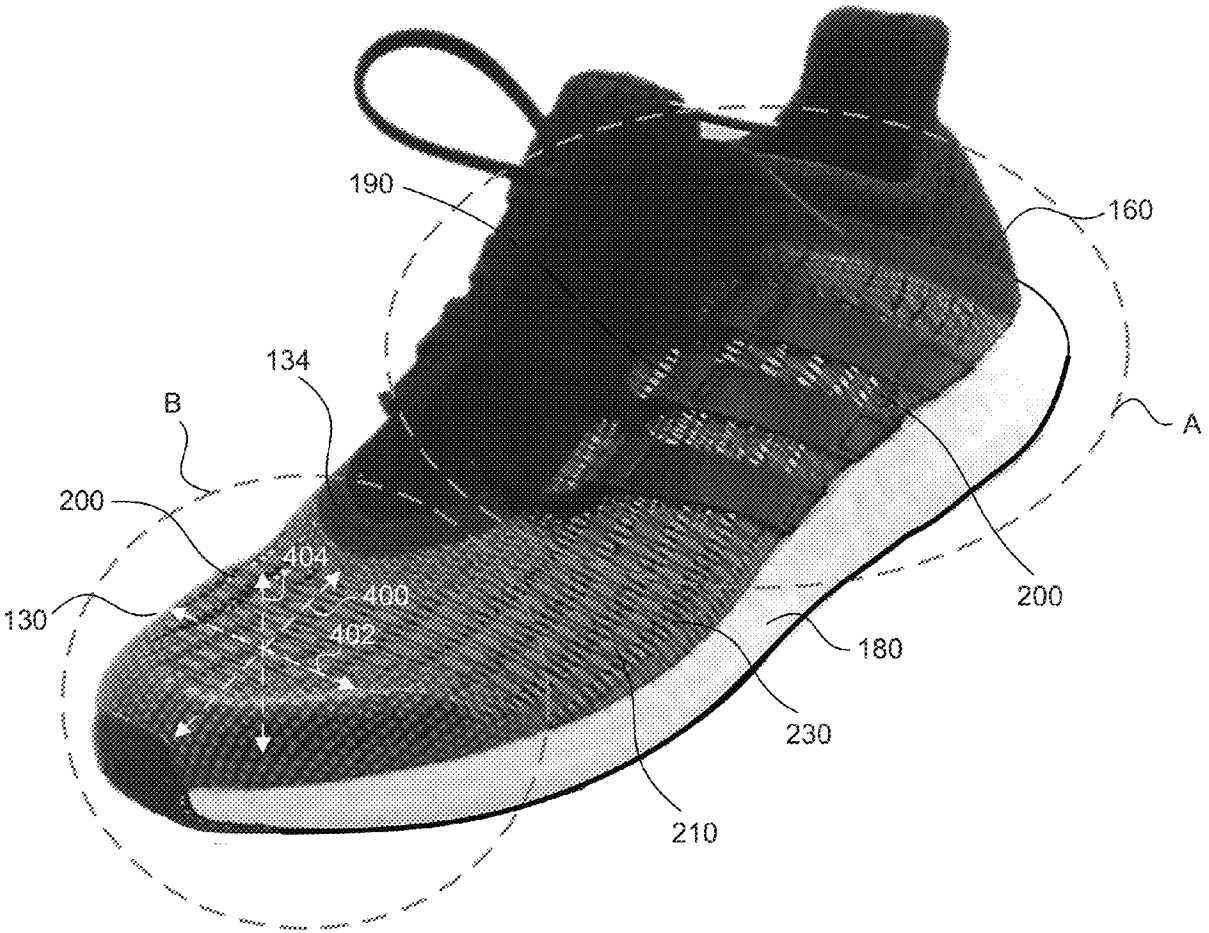
FIG. 4 is a perspective view of an article of footwear according to an embodiment.

Leno woven fabric 200 may comprise a plurality of weft yarns 210 extending in a substantially longitudinal direction (e.g., longitudinal direction 400, y-axis) from forefoot portion 110 of article of footwear 100 towards heel portion 114 of article of footwear 100 and a plurality of warp yarns 230 extending in a transverse direction (e.g., transverse direction 402, x-axis) substantially perpendicular to warp yarns 210. As shown in FIG. 4, for example, longitudinal direction 400 runs along the length of article of footwear 100 and transverse direction 402 runs along the width of article of footwear 100. In some embodiments, the orientation of weft yarns 210 and warp yarns 230 may be reversed (i.e., leno woven fabric 200 may comprise a plurality of weft yarns 210 extending in a substantially transverse direction (e.g., transverse direction 402) a plurality of warp yarns 230 extending in longitudinal direction 400 substantially perpendicular to weft yarns 210).

Weft yarns 210 extending in a substantially longitudinal direction 400 need not be disposed completely on a single longitudinal plane. For example, as shown in FIG. 4, weft yarns 210 may extend up or down in a substantially vertical direction (e.g., vertical direction 404, z-axis) to follow the contour of the outer surface of article of footwear 100. Similarly, warp yarns 230 extending in a substantially transverse direction 402 need not be disposed completely on a single transverse plane. For example, as shown in FIG. 4, warp yarns 230 may extend up or down in a substantially vertical direction 404 to follow the contour of the outer surface of article of footwear 100.

Warp yarns 230 may comprise a polymeric yarn, including, but not limited to, a co-polyester yarn or a polyurethane yarn, nylon, and aliphatic or semi-aromatic polyamides. In some embodiments, the size of warp yarns 230 may be in the range of 3000 denier to 500 denier. In some embodiments, the size of warp yarns 230 may be in the range of 2300 denier to 1200 denier.

Weft yarns 210 may comprise at least one of a moisture wicking yarn, an antibacterial yarn, a thermally conductive yarn, and a combination thereof. Suitable moisture wicking yarn materials include, but are not limited to, co-polyethylene and Nylon. In some embodiments, moisture wicking yarns may include a deep grooved fiber, such as 4DG™, manufactured by Fiber Innovation Technology, Inc. In some embodiments, the geometry (e.g., cross-sectional shape or surface characteristics) of the yarns affects the moisture wicking properties of the yarn, for example, by facilitating capillary action. Suitable antimicrobial yarn materials include, but are not limited to, polygene or silver fiber (e.g., X-Static® manufactured by Noble Biomaterials). In some embodiments, an antimicrobial yarn may include a non-antimicrobial base yarn embedded, impregnated, or co-woven with an antimicrobial material/yarn.

Suitable materials for thermally conductive yarns include, but art not limited to metallic materials, such as but, not limited to, aluminum, silver, combinations thereof, and alloys thereof. In some embodiments, a deluster additive may be added to the metallic material. In some embodiments, thermally conductive yarns may be a yarns coated with one or more metallic materials, such as but not limited to, aluminum, silver, combinations thereof, and alloys thereof. In some embodiments, thermally conductive yarns may include one or more additives to improve thermal conductivity, such as but not limited to antistatic additives. In some embodiments, the antistatic additive may be one or more ionic liquids of medium polarity.

In some embodiments, leno woven fabric 200 may include one or more types weft yarns 210. As a non-limiting example, in some embodiments, leno woven fabric 200 may include one or more moisture wicking weft yarns, one or more antimicrobial yarns, and one or more thermally conductive yarns. As another non-limiting example, leno woven fabric 200 may include a plurality of moisture wicking yarns and a plurality of thermally conductive yarns. The location and number of each type of weft yarn within leno woven fabric 200 may be configured to provide desired characteristics to one or more sections of upper 120. For example, in some embodiments, the location and number of each type of weft yarn within leno woven fabric 200 may be configured to provide desired characteristics to one or more of heel counter 300, ankle cuff 310, dorsal section 320 vamp section 330, toe box section 340, and quarter sections 350 of upper 120. In some embodiments, the location, number, and configuration of targeted zones on article of footwear 100 may be determined by studying different physiological processes of the human foot as discussed in U.S. patent application Ser. No. 12/926,051, filed on Oct. 22, 2010, now U.S. Pat.

No. 8,910,313, the disclosure of which is incorporated by reference herein in its entirety.

In some embodiments, leno woven fabric 200 may provide improved thermal regulation on a systematic basis (e.g., help maintain the body temperature during an activity at cold or warm outdoor temperatures at approximately 37 degrees Celsius). This may support not only the wellness but also the performance of the wearer of the footwear since muscles, nerves, heart, and breathing are positively supported.

In some embodiments, leno woven fabric 200 (and portions of an article of footwear composed of leno woven fabric 200) may include one or more climate zones configured to provide desired characteristics to an article of footwear (e.g., article of footwear 100). FIGS. 14 and 15 show exemplary temperature and sweat zones on a foot which may be used to determine the location and size of the climate zones for a leno woven fabric discussed herein.

In some embodiments, a first climate zone has both a high skin temperature and strong sweat production. Such areas require both cooling and removal of sweat. This may be achieved by a higher degree of air permeability which evaporates the sweat together with the high skin temperature. Thereby sweat is removed from the skin, and the skin is cooled by the evaporative heat loss. To this end, the article of footwear includes increased air permeability along the first climate zone in one embodiment. In some embodiments, a leno woven fabric may be configured to provide increased air permeability in a first climate zone. For example, a leno woven fabric having large openings 750 and/or a large number of openings 750 located in a first climate zone may provide increased air permeability.

In some embodiments, a second climate zone includes increased moisture wicking arranged in areas of the foot that are characterized by high production of sweat and by skin temperatures in the medium or low range so that evaporation is lower than in the first climate zone. In these areas, sweat may accumulate which does not evaporate so that the article of footwear gets wet in this area. This problem may be solved by wicking the additional sweat to the outside of the footwear where the sweat can evaporate. The second climate zone therefore includes increased moisture wicking of the material of the footwear in one embodiment. In some embodiments, a leno woven fabric may be configured to provide increased moisture wicking in a second climate zone. For example, a leno woven fabric having a large number of weft yarns located in a second climate zone comprising a moisture wicking material may provide for increased moisture wicking.

In some embodiments, a third climate zone is arranged in areas of the foot which are characterized by a low skin temperature and a low sweat production together with strong wind pressure. These areas which are subject to strong wind pressure and should preferably be protected from over cooling. This problem may be solved by wind proof materials so that the third climate zone comprises an increased wind protection of the material of the footwear in one embodiment. In some embodiments, a leno woven fabric may be configured to provide increased wind protection in a third climate zone. For example, a leno woven fabric having small openings 750 and/or a small number of openings 750 located in a third climate zone may provide increased wind protection.

In some embodiments, a fourth climate zone is arranged in areas of the foot which show a high skin temperature while having low sweat production. These areas therefore require additional cooling. This problem may be solved by heat conducting materials of the footwear which conduct heat away from the skin surface to the outside of the footwear and thereby cool the foot. The fourth climate zone therefore includes increased heat conductivity (e.g., a reduced thermal resistance, of the material of the footwear in one embodiment). In some embodiments, a leno woven fabric may be configured to provide increased heat conductivity in a fourth climate zone. For example, a leno woven fabric having a large number of weft yarns located in a fourth climate zone comprising a material with high thermal conductivity may provide for increased heat conductivity.

In some embodiments, a fifth climate zone concerns areas of the foot with low skin temperature and low sweat production which therefore require protection from over cooling. This is similar to the third climate zone which, however, only protects areas on the front side of the foot being exposed to high wind pressure. Therefore, the fifth climate zone provides additional heat insulation, in particular at low temperatures, for example in autumn and winter in one embodiment. In some embodiments, a leno woven fabric may be configured to provide additional heat insulation. For example, a leno woven fabric having small openings 750 and/or a small number of openings 750 located in a firth climate zone may protect from overcooling. As another example, a leno woven fabric having a large number of weft yarns located in a fifth climate zone comprising a material with low thermal conductivity may provide for additional heat insulation.

In some embodiments, a sixth climate zone may include vents arranged on the footwear to provide supply of fresh air. This causes an additional removal of heat and evaporated sweat. The vents are arranged so that they provide ventilation in areas with high skin temperature and/or high sweat production. Preferably, the vents are arranged so that the air can circulate "around" the foot. In some embodiments, a vent may act as an entry vent, and another vent may act as an exit vent. In some embodiments, a leno woven fabric may form a portion of the vents and/or support vents (e.g., couple vents to an article of footwear).

In some embodiments, leno woven fabric 200 may be a continuous fabric layer. In other words, leno woven fabric 200 may not include any seams separating different sections/regions of leno woven fabric 200. In some embodiments, different sections/regions of leno woven fabric 200 may defined by different leno weave patterns.

In some embodiments, leno woven fabric 200 may be a continuous fabric layer having at least a portion extending from forefoot portion 110 of article of footwear 100 to midfoot portion 112 of article of footwear 100. In some embodiments, leno woven fabric 200 may be a continuous layer having at least a portion extending from forefoot portion 110 of article of footwear 100 to heel portion 114 of article of footwear 100. As a non-limiting example, article of footwear 100 shown in FIGS. 1-4, shows upper 120 including leno woven fabric 200 having a continuous portion extending from forefoot portion 110 to heel portion 114. In some embodiments, leno woven fabric 200 may be a continuous layer having a portion extending from midfoot portion 112 to heel portion 114. In some embodiments, leno woven fabric 200 may be a continuous layer having a portion extending from toe box section 340 of upper 120 to vamp section 330 of upper 120. In some embodiments, leno woven fabric 200 may be a continuous layer having a portion extending from toe box section 340 of upper 120 to quarter section(s) 350 of upper 120. In some embodiments, leno woven fabric 200 may be a continuous layer having a portion extending from vamp section 330 of upper 120 to quarter section(s) 350 of upper 120.

In some embodiments, leno woven fabric 200 of upper 120 may be coupled to sole 180. In some embodiments, leno woven fabric 200 may be directly coupled to sole 180 at sole connection area 136 (via, e.g., adhesive bonding, stitching, lamination (e.g., high frequency welding or heat welding), or a combination thereof). In some embodiments, leno woven fabric 200 may be a continuous layer having a portion extending from lateral side 108 of article of footwear 100 to medial side 106 of article of footwear 100. In some embodiments, leno woven fabric 200 may be directly coupled to sole 180 at one or more locations on lateral side 108 and/or medial side 106 of sole 180. In such embodiments, at least one of a first end 232 and a second end 234 of one or more warp yarns 230 may be directly coupled to sole 180. In some embodiments, one or more warp yarns 230 includes a first end 232 directly coupled to sole 180 and a second end 234 directly coupled to sole 180. In some embodiments, one or more warp yarn 230 includes a first end 232 directly coupled to lateral side 108 of sole 180 and a second end 234 directly coupled to medial side 106 of sole 180 (see e.g., FIGS. 1 and 2).

In some embodiments, leno woven fabric 200 may be coupled to second portion 160. In some embodiments, leno woven fabric 200 may be directly coupled to second portion 160 at upper connection area 134 (via, e.g., adhesive bonding, stitching, lamination (e.g., high frequency welding or heat welding), or a combination thereof). In some embodiments, leno woven fabric 200 may be a continuous layer having a portion extending from sole 180 to second portion 160. In some embodiments, one or more weft yarns 210 includes a first end 212 directly coupled to second portion 160 and a second end 214 directly coupled to sole 180 of article of footwear 100. In some embodiments, all the weft yarns 210 of upper 120 include first ends 212 directly coupled to second portion 160 and second ends 214 directly coupled to sole 180 of article of footwear 100. In some embodiments, one or more weft yarns 210 includes a first end 212 directly coupled to second portion 160 at a first location and a second end 214 directly coupled to second portion 160 at a second location. In some embodiments, one or more warp yarns 230 includes a first end 232 directly coupled to sole 180 and a second end 234 directly coupled to second portion 160 (or vice versa).

Direct coupling of the ends of one or more warp yarns 230 to sole 180 and/or second portion 160 may provide structural integrity for article of footwear 100 by reducing the number of seams (or connection points) located on article of footwear 100. Additionally, direct coupling may simplify the manufacturing of article of footwear 100, thereby reducing manufacturing costs. Similar to the direct coupling of the ends of one or more warp yarns 230 to sole 180 and/or second portion 160, the direct coupling of one or more weft yarns 210 to second portion 160 and/or sole 180 may provide structural integrity for article of footwear 100 by reducing the number of seams (or connection points) located on article of footwear 100 and simplifying the manufacturing of article of footwear 100. Additionally, direct coupling of weft yarns 210 and/or warp yarns 230 may provide desired directional stretchability and/or strength for article of footwear 100.

The woven configuration of weft yarns 210 and warp yarns 230 may produce an upper 120 having desired characteristics (e.g., desired stretchability, breathability, antimicrobial protection, thermal conductivity, etc.). The weaving of warp yarns 230 in leno woven fabric 200 may form a plurality of eyelets 236 and a plurality of twists 238. One or more weft yarns 210 may pass through eyelets 236 to form a leno weave configuration having a pattern. Twists 238 separate weft yarns 210 (or a plurality (i.e. sets) 220 of weft yarns 210) in leno woven fabric 200. The location and configuration of eyelets 236 and twists 238 may influence the pattern of leno woven fabric 200, which may influence one or more characteristics of leno woven fabric 200. The number of weft yarns 210 woven through eyelets 236 at different locations on upper 120 may be employed to vary the pattern of leno woven fabric 200 and therefore the characteristics of leno woven fabric at different locations on upper 120. In some embodiments, leno woven fabric 200 may have a non-uniform honeycomb pattern the same as or similar to leno weave patterns 700 and 1200 discussed herein.

Figure 5:
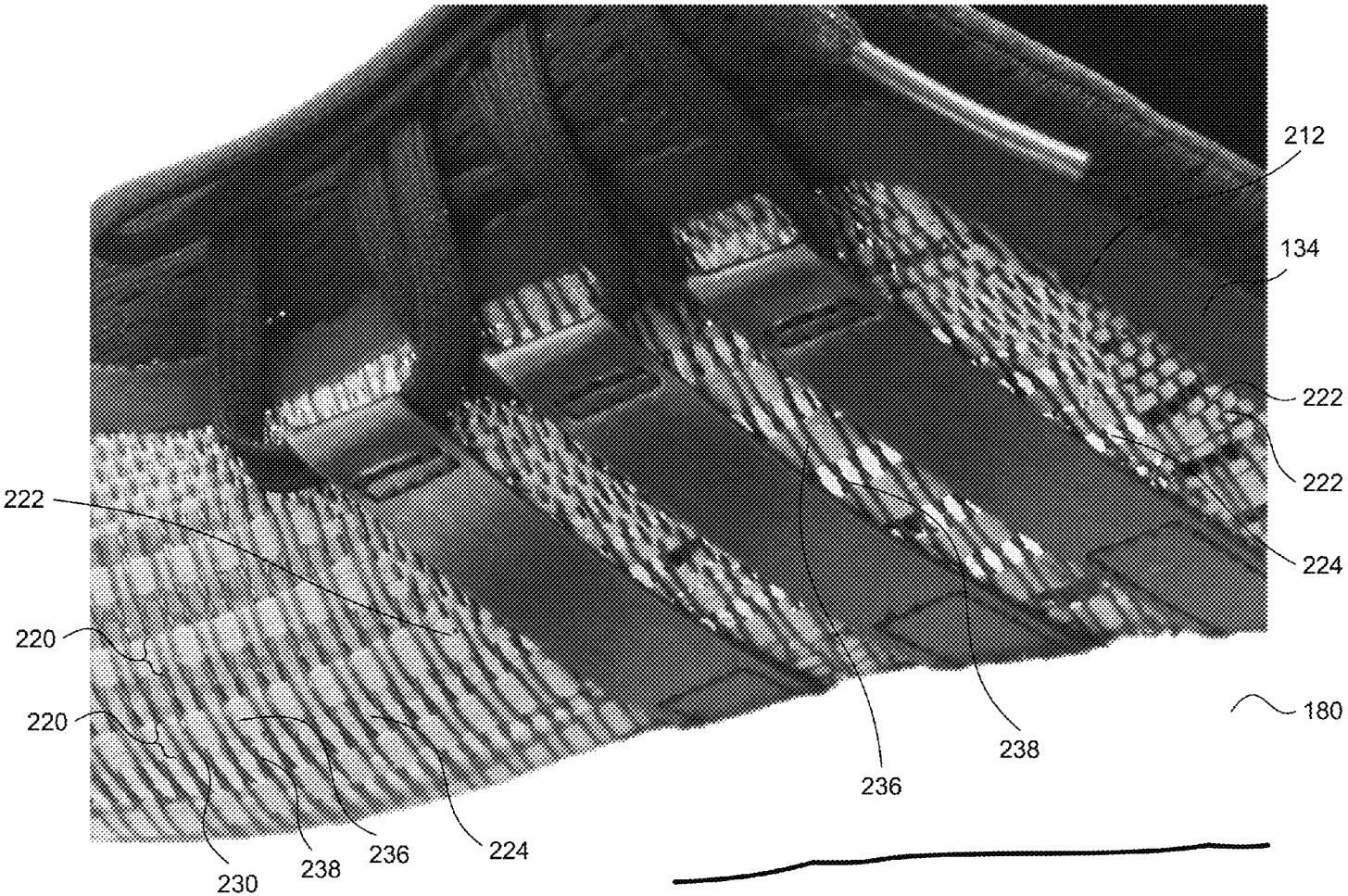
FIG. 5 is a zoomed in view of area A of the article of footwear in FIG. 4 according to an embodiment.
Figure 6:
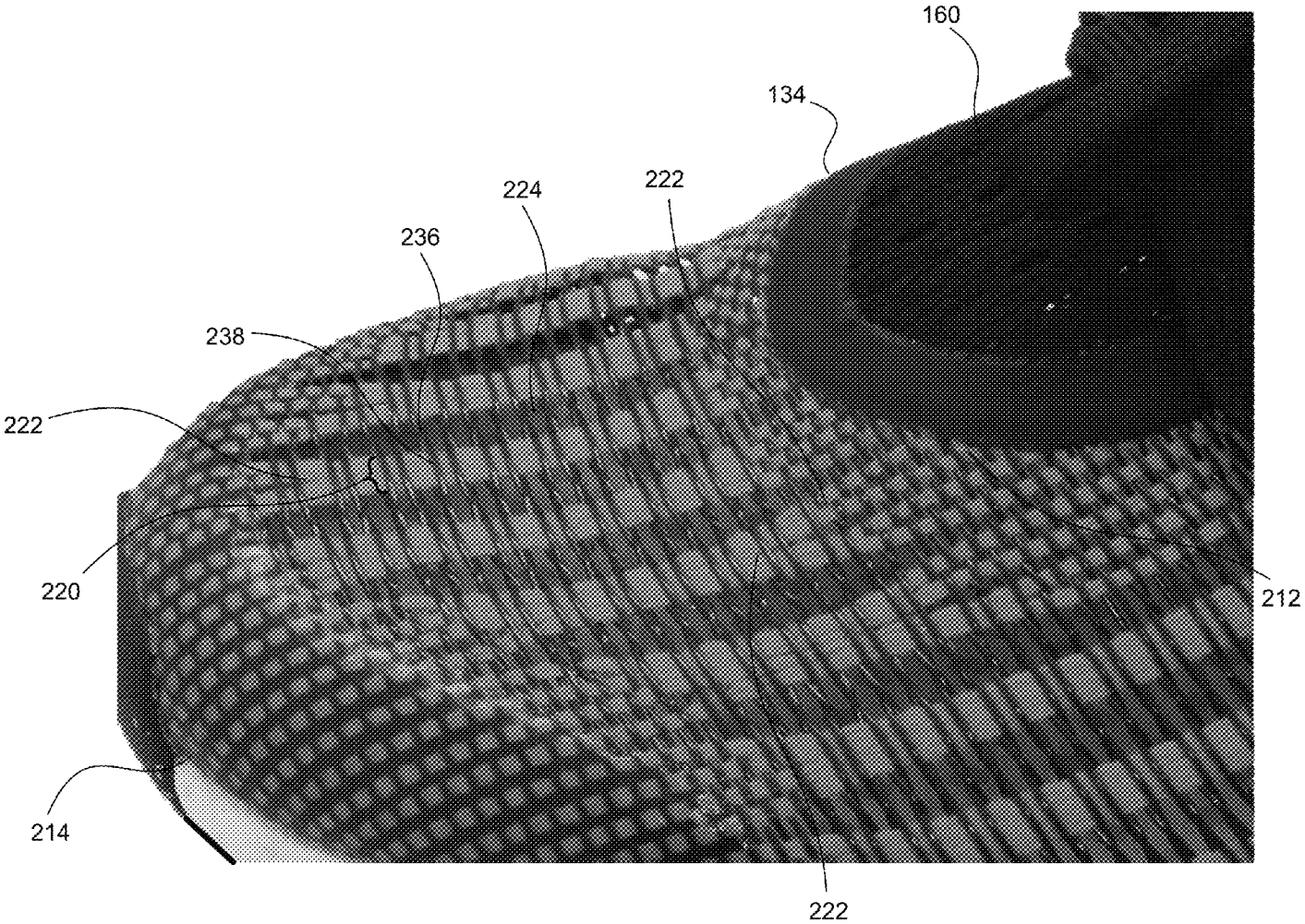
FIG. 6 is a zoomed in view of area B of the article of footwear in FIG. 4 according to an embodiment.

FIGS. 5 and 6 show zoomed in views of areas A and B in FIG. 4, respectively, and show exemplary leno weave patterns in these areas according to some embodiments. In particular, FIG. 5 shows a zoomed in view of a quarter section 350 of article of footwear 100 and FIG. 6 shows a zoomed in view of toe box section 340 and vamp section 330 of article of footwear 100. As shown in FIGS. 5 and 6, the pattern of leno woven fabric (i.e., the configuration of eyelets 236 and twists 238, and number of weft yarns 210 passing through eyelets 236) may be non-uniform. In embodiments including laces, such as laces 192 of article of footwear 100, a plurality of eyelets 236 may serve to support the laces. This may remove the need to provide separate lace-hole structures.

As shown, for example in FIG. 5, leno woven fabric 200 may include one or more sets 220 of at least two weft yarns 210 arranged side-by-side along at least a portion of upper 120. As used herein, the term "side-by-side" means that one or more weft yarns 210 are disposed next to each other in a set with each weft yarn in the set contacting the one next to it. As discussed herein, a set 220 of weft yarns 210 need not be arranged side-by-side along their entire length. One or more weft yarns 210 in a set 220 may split from the set 220 at one or more points on upper 120. In some embodiments, a weft yarn 210 that splits from a set 220 may re-converge with the set 220. In some embodiments, weft yarns 210 may not be arranged in sets, but rather, may be woven as single yarns not in contact with other yarns.

In some embodiments, one or more sets 220 may extended from second portion 160 to sole 180 of article of footwear 100 with at least two weft yarns 210 arranged side-by-side along at least a portion of upper 120. In some embodiments, each weft yarn 210 in a set 220 of weft yarns 210 includes a first end 212 coupled to second portion 160 and a second end 214 coupled to sole 180 of article of footwear 100. In some embodiments, a set 220 of weft yarns 210 is an even numbered set of weft yarns 210.

One or more sets 220 of weft yarns 210 may split at one or more split points 222 on upper 120. In some embodiments, split points 222 may be configured to form openings (e.g., openings 750) in upper 120. Weft yarns 210 may be split by a warp yarn 230 woven in between them. Split points 222 and/or openings may be configured (e.g., located on upper 120 and arranged relative to other split points 222 or portions of leno woven fabric 200) to provide ventilation for upper 120. In some embodiments, the configuration of split points 222 and/or openings may provide varying degrees of ventilation at different locations on upper 120 (e.g., in different sections such as vamp section 330, toe box section 340, and quarter section 350, or regions thereof). In some embodiments, split points 222 may provide directional stretchability and/or variable stretchability for upper 120 (e.g., in different sections such as vamp section 330, toe box section 340, and quarter section 350, or regions thereof). In some embodiments, the first strength may be less than the second strength. In some embodiments, as shown in FIGS. 5 and 6, one or more sets 220 of weft yarns 210 may be split at upper connection area 134 and/or sole connection area 136.

In some embodiments, leno woven fabric 200, or a portion thereof, may have a first stretchability in longitudinal direction 400 and a second stretchability in transverse direction 402. In some embodiments, the first stretchability may be greater than the second stretchability. In some embodiments, the first stretchability may be less than the second stretchability. In some embodiments, the stretchability of leno woven fabric may be configured to have an angled stretchability (i.e., a maximum or minimum stretchability in a direction between longitudinal direction 400 and transverse direction 402). In some embodiments, the stretchability of leno woven fabric may be angled at 45° relative to longitudinal direction 400. In some embodiments, different degrees and/or directions of stretchability in different section/regions of upper 120 may be used to create angled stretchability for upper 120 as a whole.

Similar to stretchability, the configuration of split points 222 may provide directional and/or variable strength for upper 120. For example, in some embodiments, leno woven fabric 200, or a portion thereof, may have a first strength in longitudinal direction 400 and a second strength in transverse direction 402. In some embodiments, the first strength may be greater than the second strength. In some embodiments, split points 222 may be configured to form openings (e.g., openings 750) to provide directional and/or variable strength for upper.

The pattern of leno woven fabric (e.g., the configuration of eyelets 236 and twists 238, and number of weft yarns 210 passing through eyelets 236) may be tailored to provide varying degrees of ventilation and/or thermal conductivity on upper 120. For example, arranging weft yarns 210 in a side-by-side configuration and weaving them through a single eyelet 236 may increase ventilation by creating large spaces 224 for air flow between weft yarns 210. In contrast, splitting weft yarns 210 and weaving them through different eyelets 236 may create smaller spaces 224 between weft yarns, thereby reducing air flow through leno woven fabric 200. As a non-limiting example, FIGS. 4-6 show a leno woven fabric having a configuration that results in higher ventilation, which may be provided by larger spaces 224, in center regions of vamp section 330 and a quarter section 350 when compared to the peripheral regions of those sections and toe box section 340. In some embodiments (e.g., embodiments, including a single layer leno woven fabric), spaces 224 may be through holes in upper 120. Smaller spaces 224 may also increase strength.

Similar to ventilation, thermal conductivity may be tailored by varying the arrangement of weft yarns 210. Additionally, thermal conductivity may be tailored by providing weft yarns 210 made using materials having different thermal conductivity in different sections/regions of upper 120.

Figure 7:
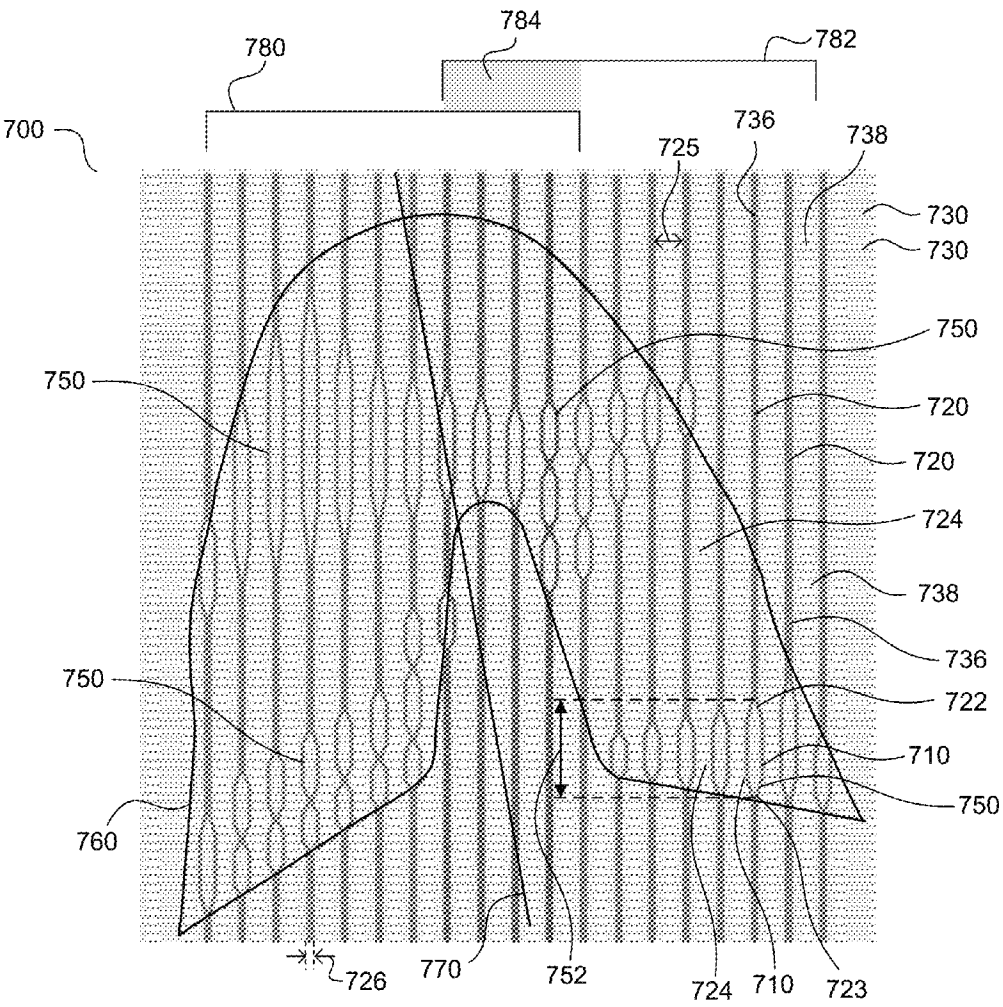
FIG. 7 is a leno weave pattern according to an embodiment.

FIG. 7 shows an upper pattern having a leno weave pattern 700 according to an embodiment that may be used to tailor one or more characteristics of a leno woven fabric (e.g., leno woven fabric 200) and therefore one or more characteristics of an upper (e.g., upper 120). Leno weave pattern 700 includes a plurality of weft yarns 710 and warp yarns 730 woven to create a pattern. In some embodiments, leno weave pattern 700 may have a non-uniform pattern. In some embodiments, leno weave pattern 700 may have a non-uniform pattern comprising one or more openings 750. In some embodiments, openings 750 may have a honeycomb or hexagonal shape. In some embodiments, as shown in FIG. 7, leno weave pattern 700 may have a non-uniform honeycomb pattern comprising one or more honeycomb shaped openings 750 having an uneven distribution. Openings 750 may be formed by splitting one or more weft yarns 710 at a first split point 722 and re-converging the one or more weft yarns 710 at a second split point 723.

As shown in FIG. 7, a set 720 of weft yarns 710 may be arranged side-by-side and woven through a single eyelet 736 along a portion of leno weave pattern 700. At first split point 722, weft yarns 710 may split and then weave through two different eyelets 736 with a twist 738 located between the eyelets 736. The weft yarns 710 may remain split for a certain distance (i.e., length 752) and then re-converge at second split point 723 by weaving them though a single eyelet 736 again. In some embodiments, a set 720 of weft yarns 710 may split in half at a split point (e.g., a set of four weft yarns may split into two sets of two weft yarns or a set of two weft yarns may split into two single weft yarns). In some embodiments, a set of weft yarns may unevenly split at a split point (e.g., a set of four weft yarns may split into a set of three weft yarns and a single weft yarn). In embodiments including laces, a plurality of eyelets 736 may serve to support the laces. This may remove the need to provide separate lace-hole structures.

In some embodiments, width 725 of space 724 between two sets 720 of weft yarns 710 (or single weft yarns 710) arranged next to each other may be in the range of 5 mm to 7 mm. In some embodiments width 725 of space 724 between two sets 720 of weft yarns 710 arranged next to each other may be approximately 6 mm. Splitting weft yarns 710 may reduce the width 725 of the space 724 between weft yarns 710 (or sets 720 of weft yarns). In some embodiments, a set 720 of weft yarns 710 arranged side-by-side may have a width in the range of 2 mm to 4 mm. In some embodiments, a set 720 of weft yarns 710 arranged side-by-side may have a width 726 of approximately 3 mm.

The location, number, and distribution of openings 750 may be used to tailor one or more characteristics of a leno woven fabric. Moreover, selecting different lengths 752 for different openings 750 can tailor one or more characteristics of a leno woven fabric. The location, number, distribution, and size of openings 750 may be configured to provide desired ventilation, thermal conductivity, moisture wicking, directional stretchability, and directional strength for a leno woven fabric (e.g., leno woven fabric 200) and an upper (e.g., upper 120) including the leno woven fabric. For example, openings 750 with a relatively long length may increase ventilation of the leno woven fabric.

As illustrated in FIG. 7, the material used for weft yarns 710 may vary within leno weave pattern 700 to alter one or more characteristics of a leno woven fabric. In some embodiments, different sets 720 of weft yarns 710 may be made of different weft yarn materials. In some embodiments, different weft yarns 710 within a set 720 of weft yarns 710 may be made of different weft yarn materials. In some embodiments, leno weave pattern 700 may include a first region 780 woven with weft yarns 710 having a first characteristic and a second region 782 woven with weft yarns 710 having a second characteristic. In some embodiments, each weft yarn 710 in first region 780 may be made out of a first material having a first characteristic (e.g., a material having good moisture wicking properties) and each weft yarn 710 in second region 782 may be made out of a second material having a characteristic that is different from weft yarns 710 in first region 780 (e.g., a material having a high thermal conductivity). In some embodiments, weft yarns 710 in first region 780 and in second region 782 may be made out of materials having the same general characteristic(s), but varying degrees of those characteristic(s) (e.g., weft yarns 710 in first region 780 made of a thermally conductive material having a thermal conductivity of X and weft yarns in second region made of a thermally conductive material having a thermal conductivity of 2×).

In some embodiments, first region 780 and second region 782 may overlap to form a transition region 784. Transition region 784 may include weft yarns 710 made from a first material and weft yarns 710 made from a second material. In some embodiments, transition region 784 may include a gradient concentration of weft yarns 710 made of the first material and weft yarns 710 made of the second material. As a non-limiting example, Table 1 below illustrates a concentration gradient for a transition region 784 having three sets 720 of weft yarns 710, with four weft yarns 710 in each set. In Table 1, a=a weft yarn made out of a first material and b=a weft yarn made out of a second material.

TABLE 1

Weft yarn set components and concentrations for an exemplary transition region 784

| | First Region 780 | | Transition Region 784 | | | Second Region 782 | | |
|---|---|---|---|---|---|---|---|---|
| Weft Yarn Components | ... 4a:0b | 4a:0b | 3a:1b | 2a:2b | 1a:3b | 0a:4b | 0a:4b | ... |
| Weft Yarn Concentrations | ... 100% a | 100% a | 75% a<br>25% b | 50% a<br>50% b | 25% a<br>75% b | 100% b | 100% b | ... |

While Table 1 shows transition region 784 having three weft yarn sets 720 each with four weft yarns 710, transition region 784 may include any number of weft yarn sets 720 with any number of weft yarns 710. Also, the number of weft yarns 710 in each weft yarn set 720 (in any region) need not be the same. In some embodiments, the concentration of weft yarn components may varied by varying the number of weft yarns in a set 720 of weft yarns 710. Table 1 shows a concentration gradient that is linear and evenly distributed across a transition region 784, but in some embodiments, the concentration gradient in a transition region may be non-linear and/or non-uniform. In some embodiments, leno weave pattern 700 may have more than one transition region 784. In some embodiments, transition region(s) 784 may vary the characteristics of a leno woven fabric in transverse direction 402. In some embodiments, a set 720 weft yarns 710 may be a composite yarn set woven with yarns having different characteristics so as to vary the characteristics of a leno woven fabric in longitudinal direction 400 (e.g., a leno woven fabric may have transition regions in longitudinal direction 400 as well as transverse direction 402).

In some embodiments, one or more weft yarns 710 may be made of a third material, and a fourth material. In some embodiments, a single weft yarn 710 may have more than one component, each with a different characteristic. For example, a single weft yarn 710 may be a composite yarn woven with yarns having different characteristics. In some embodiments, a single weft yarn 710 may be a composite yarn woven with yarns having different characteristics so as to vary the characteristics of a leno woven fabric in longitudinal direction 400. In some embodiments, each weft yearn 710 in a group 720 may have one different characteristic.

While tailoring characteristics of leno weave pattern 700 have been described in connection with varying one or more characteristics of weft yarns 710, tailoring characteristics of leno weave pattern 700 may alternatively or additionally be accomplished by varying one or more characteristics of warp yarns 730. As a non-limiting example, weft yarns 710 may have one characteristic, such as moisture transport, and warp yarns 730 may have another characteristic, such as antimicrobial protection.

FIG. 7 also shows an exemplary upper pattern having a perimeter 760 for a first portion (e.g., first portion 130) of an upper (e.g., upper 120). The angle at which the first portion is cut from leno weave pattern 700 may be selected to provide desired characteristics (e.g., directional stretchability and/or strength) for the first portion. FIG. 7 also shows an exemplary upper mid-line 770 which may be used to set the angle at which the first portion is cut from leno weave pattern 700. Upper mid-line 770 is an imaginary line running along the geometrical center of an upper in longitudinal direction 400 (see e.g., FIG. 10). In some embodiments, as shown in FIG. 7, leno weave patter 700 may have a non-symmetrical pattern relative to upper mid-line 770. In some embodiments, leno weave pattern 700 may be symmetrical about a mid-point or mid-line.

Figure 8:
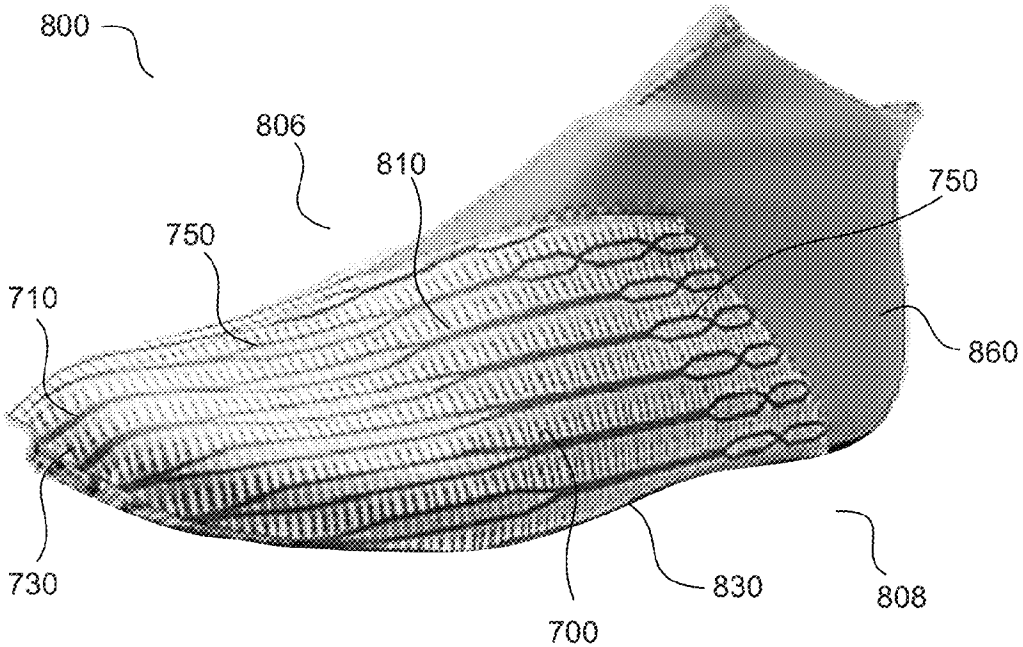
FIG. 8 is a lateral side view of an upper according to an embodiment.
Figure 9:
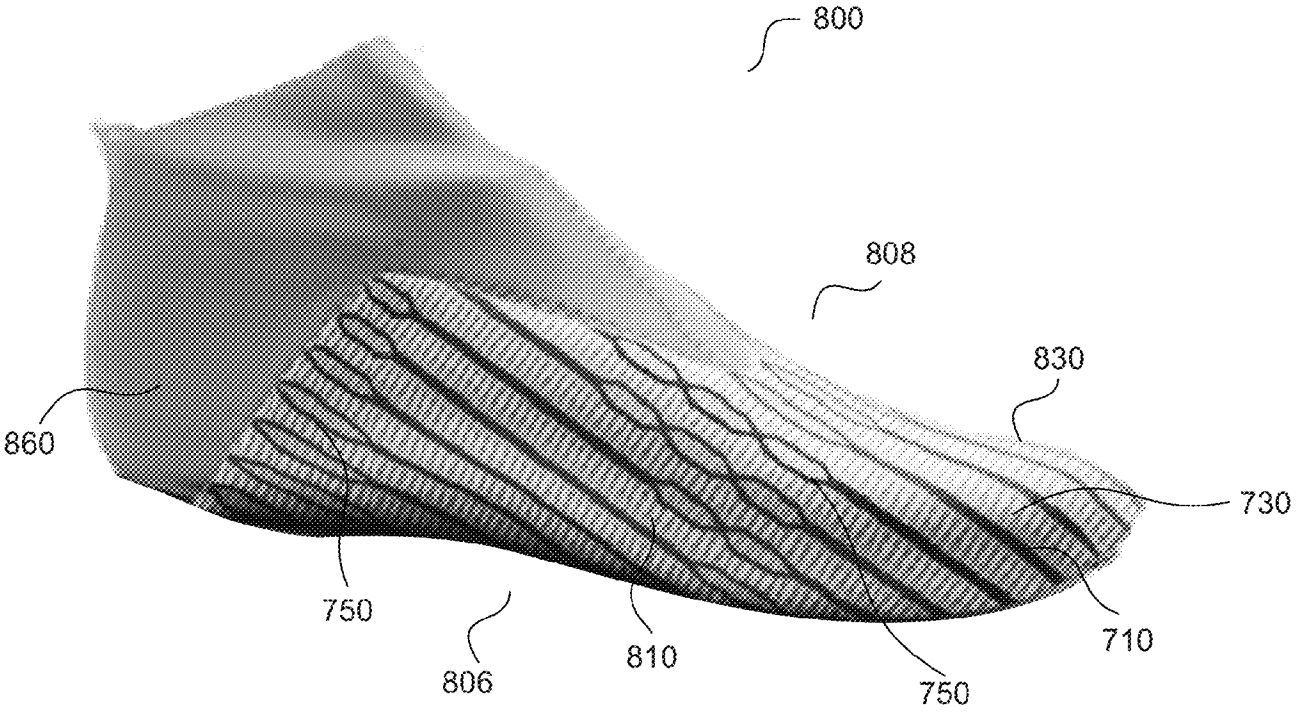
FIG. 9 is a medial side view of an upper according to an embodiment.
Figure 10:
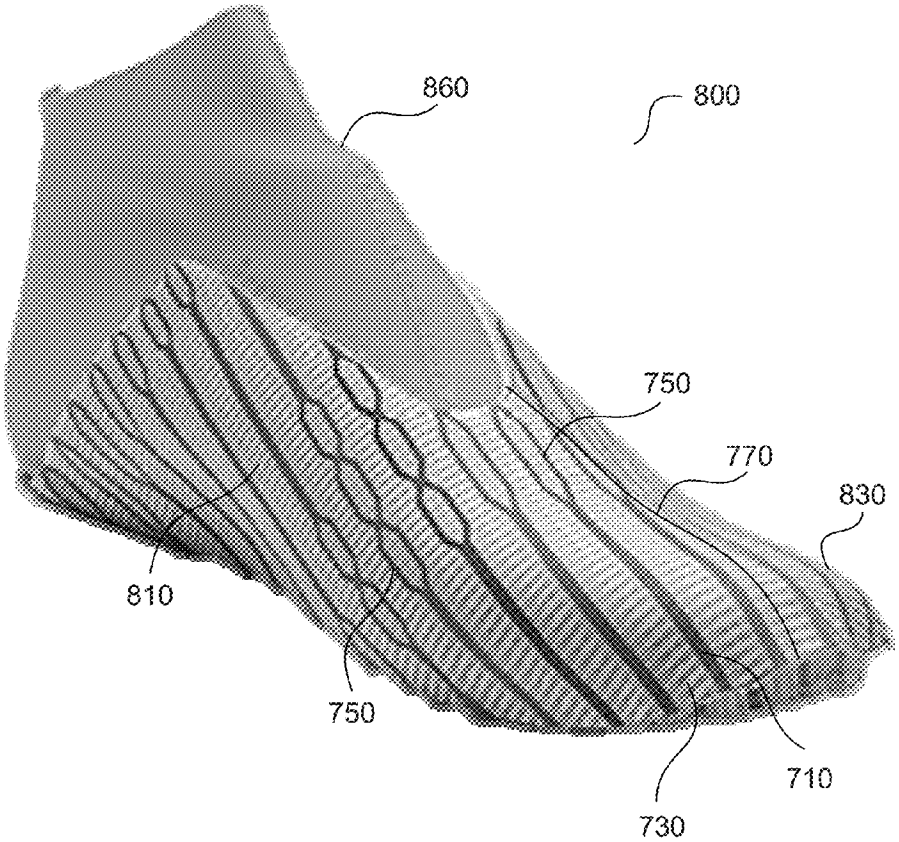
FIG. 10 is a front medial view of an upper according to an embodiment.

FIGS. 8-10 show an upper 800 constructed using a leno woven fabric 810 having leno weave pattern 700 according to an embodiment. Upper 800 may include a first portion 830 comprising leno woven fabric 810 and a second portion 860 coupled to first portion 830. First portion 830 and second portion 860 may be the same as or similar to first portion 130 and second portion 160 discussed above in regards to article of footwear 100. Moreover, first portion 830 and second portion 860 may be coupled together and to a sole in the same or substantially the same way as discussed above in regards to article of footwear 100. In some embodiments, leno weave pattern 700 of leno woven fabric 810 may be oriented such that weft yarns 710 extend in a substantially longitudinal direction (e.g., longitudinal direction 400, y-axis) along upper 800 and warp yarns 730 extend in a transverse direction (e.g., transverse direction 402, x-axis) substantially perpendicular to warp yarns 710 on upper 800. The orientation of weft yarns 710 and warp yarns 730 on upper 800 may be selected by setting the angle of upper mid-line 770 a desired angle relative to the direction of weft yarns 710 and/or warp yarns 730 in leno weave pattern 700.

In some embodiments, leno woven fabric 810 may be a single layer woven fabric. In some embodiments, leno woven fabric 810 may include more than one layer. As a non-limiting example, leno woven fabric 810 may include a textile layer coupled to and reinforced, in whole or in part, with a leno woven layer. In some embodiments, first portion 830 may consist of leno woven fabric 810.

FIGS. 8-10 also illustrate how the pattern of a leno woven fabric can be used to tailor one or more characteristics of an upper according to an embodiment. As shown when comparing FIGS. 8 and 9, openings 750 in forefoot and midfoot portions of on a lateral side 808 of upper 800 may have larger lengths 752 compared to the openings 750 in forefoot and midfoot portions on a medial side 806 of upper 800. In such embodiments, lateral side 808 may have a higher degree of breathability than medial side 806.

Figure 11:
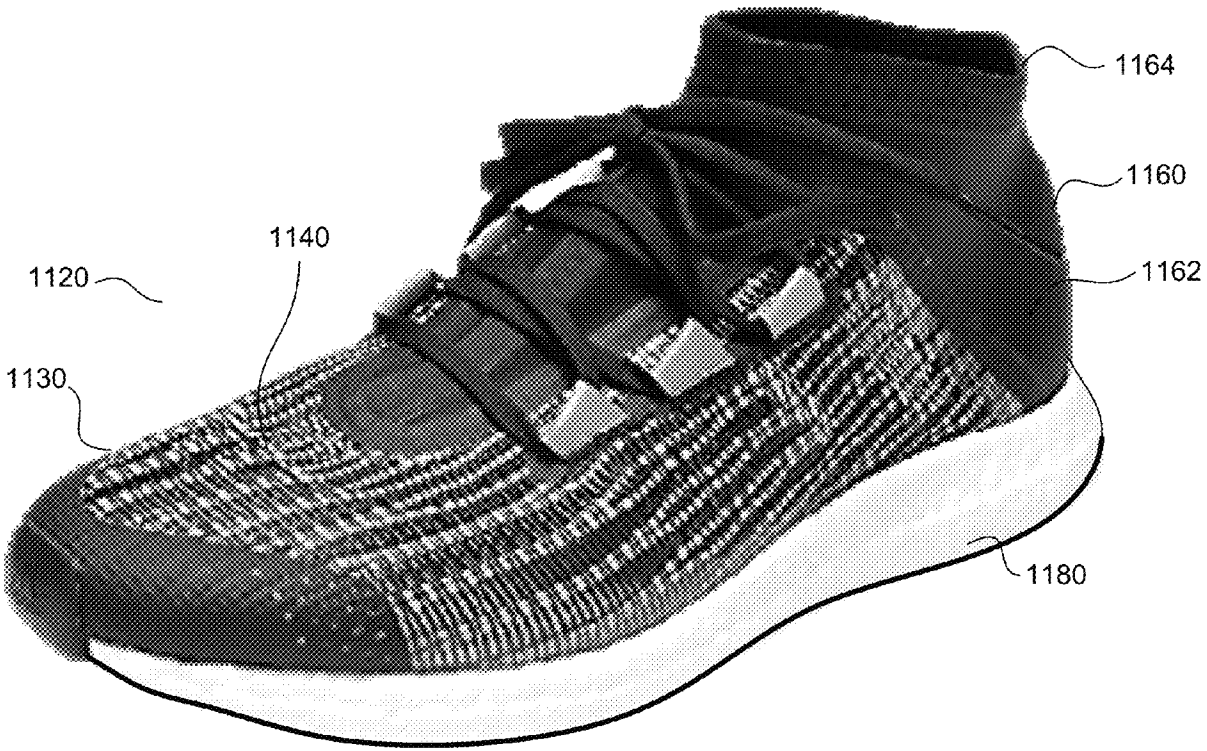
FIG. 11 is a perspective view of an article of footwear according to an embodiment.

FIG. 11 shows an article of footwear 1100 according to an embodiment. Article of footwear 1100 may include an upper 1120 coupled to a sole 1180. Sole 1180 may be the same as or similar to sole 180 discussed above in regards to article of footwear 100. Upper 1120 may include a first portion 1130 made using a leno woven fabric 1140. Leno woven fabric may be the same as or similar to any leno woven fabric discussed herein (e.g., leno woven fabrics 200 and 810). Article of footwear 1100 may also include a second portion 1160 including a heel counter 1162 and ankle cuff 1164. Second portion 1160 may be the same as or similar to second portion 160, but second portion 1160 includes a mid-top top ankle cuff 1164 for supporting a wearer's ankle Article of footwear 1110 may be worn by an individual desiring ankle support; for example, an individual playing/practicing football or basketball. FIG. 11 is one of many examples of how an article of footwear including a leno weave can be customized for a specific scenario/use.

The articles of footwear discussed herein (e.g., 100 and 1100) may be manufactured using the following exemplary method. The order of the processes discussed below is exemplary and may be rearranged depending on a number of factors, for example, but not limited to, optimization of the manufacturing process and the layout (e.g., location and process flow) of manufacturing equipment. First, a first footwear component (e.g., first portion 130) including a leno woven fabric (e.g., 200) may be coupled to a second footwear component including a heel counter (e.g., second portion 160). The first footwear component may be coupled to the second footwear component via, for example, but not limited to, adhesive bonding, stitching, lamination (e.g., high frequency welding or heat welding), or a combination thereof. In some embodiments, leno woven fabric of the first footwear component may be directly coupled, in whole or in part, to the second footwear component.

After coupling the leno woven fabric to the footwear component, the leno woven fabric may be coupled to a sole (e.g., 180) The leno woven fabric may be coupled to the sole via for example, but not limited to, adhesive bonding, stitching, lamination (e.g., high frequency welding or heat welding), or a combination thereof. In some embodiments, the leno woven fabric may be directly coupled to the sole. After or during coupling the leno woven fabric to the sole, the heel counter may also be coupled to the sole. In some embodiments, the heel counter may be coupled to the sole in the same, or substantially the same, way the leno woven fabric is coupled to the sole. In some embodiments, the heel counter may be coupled to the sole using a different process than the one used to couple the leno woven fabric to the sole.

Figure 12B:
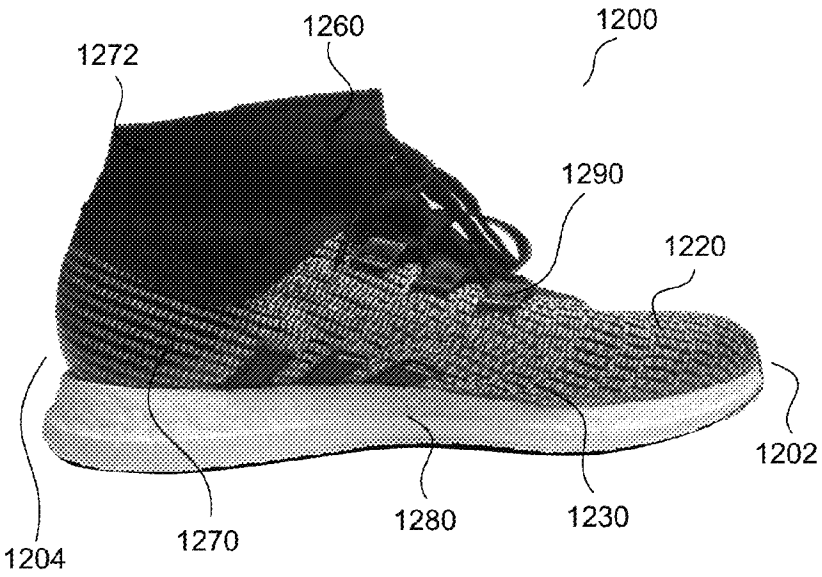
FIG. 12B is a side view of the article of footwear in FIG. 12A.
Figure 12A:
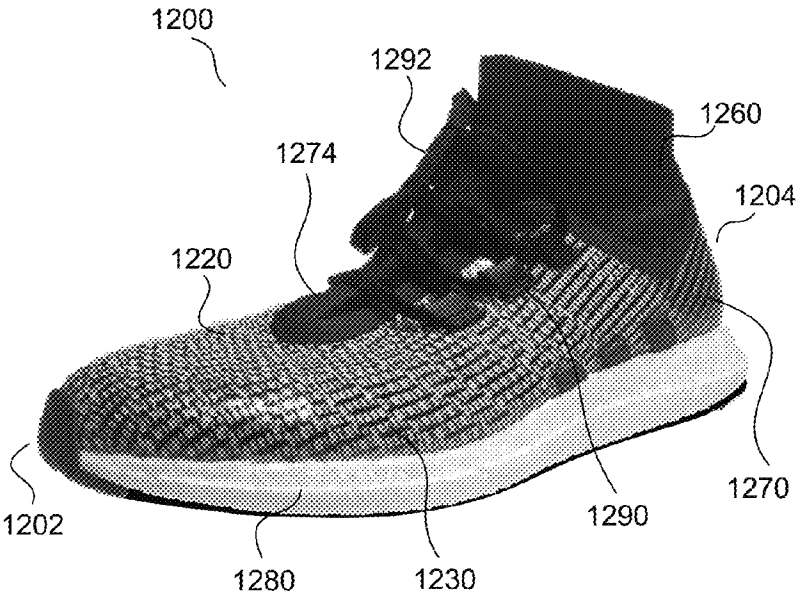
FIG. 12A is perspective view of an article of footwear according to an embodiment.

FIGS. 12A and 12B show an article of footwear 1200 according to an embodiment. Article of footwear 1200 includes a forefoot end 102, a heel end 1204, and an upper 1220 coupled to a sole 1280. Upper 1220 may include a first portion 1230 including a leno woven fabric (e.g., a leno woven fabric the same as or similar leno woven fabric 200) and a second portion 1260. In some embodiments, second portion 1260 may include an ankle cuff 1272 and a tongue 1274. First portion 1230 and second portion 1260 may be coupled to sole 1280 via for example, but not limited to, adhesive bonding, stitching, lamination (e.g., high frequency welding or heat welding), or a combination thereof. First portion 1230 may be coupled to second portion 1260 via for example, but not limited to, adhesive bonding, stitching, lamination (e.g., high frequency welding or heat welding), or a combination thereof.

In some embodiments, first portion 1230 may extend from forefoot end 1202 to heel end 1204 of article of footwear 1200. In some embodiments, first portion 1230 may wrap around heel end 1204 to form all or a portion of a heel counter 1270. In some embodiments, lamination, such as high frequency welding, may be employed to create a desired shape for heel counter 1270. For example, heel counter 1270 may include a laminated area for providing a rounded shape at heel end 1204 of article of footwear 1200 so as to wrap around at least a portion of a wearer's heel. Upper 1220 may also include one or more eye stays 1290 for securing and tensioning a shoe lace 1292.

Figure 13:
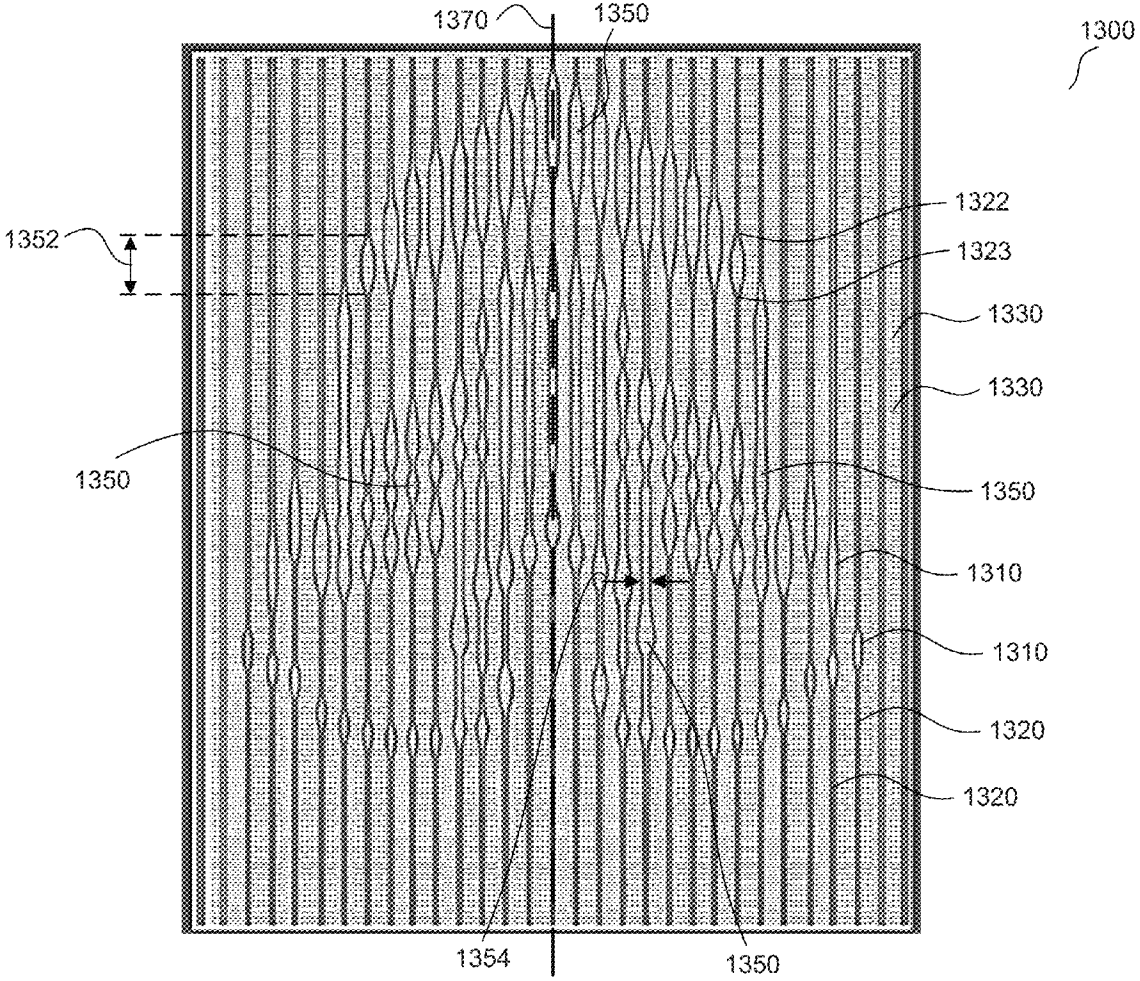
FIG. 13 is a leno weave pattern according to an embodiment.

FIG. 13 shows an upper pattern having a leno weave pattern 1300 according to an embodiment that may be used to tailor one or more characteristics of a leno woven fabric (e.g., leno woven fabric 200) and therefore one or more characteristics of an upper (e.g., upper 120). Leno weave pattern 1300 includes a plurality of weft yarns 1310 and warp yarns 1330 woven to create a pattern. In some embodiments, leno weave pattern 1300 may have a pattern comprising one or more openings 1350. In some embodiments, openings 1350 may have a honeycomb or hexagonal shape.

The weaving and characteristics of leno weave pattern 1300 may be the same as or similar to leno weave pattern 700. In some embodiments, as shown in FIG. 13, leno weave pattern 1300 may have a non-uniform honeycomb pattern comprising one or more honeycomb shaped openings 1350 having an uneven distribution. Openings 1350 may be formed by splitting one or more weft yarns 1310 at a first split point 1322 and re-converging the one or more weft yarns 1310 at a second split point 1323. Similar to leno weave pattern 700, the location, number, and distribution of openings 750 may be used to tailor one or more characteristics of a leno woven fabric.

As shown in FIG. 13, a set 1320 of weft yarns 1310 may be arranged side-by-side along a portion of leno weave pattern 1300. At first split point 1322, weft yarns 1310 may split and remain split for a certain distance (i.e., length 1352) and then re-converge at second split point 1323. In some embodiments, lengths 1352 of openings 1350 may be varied to provide one or more desired characteristics. In some embodiments, the widths 1354 of openings 1350 may be varied to provide one or more desired characteristics. In some embodiments, the width 1354 of a single opening 1350 may be varied to provide one or more desired characteristics.

In some embodiments, leno weave pattern 1300 may be symmetrical about a mid-point or mid-line. For example, as shown in FIG. 13, leno weave pattern 1300 may be symmetrical about mid-line 1370 (i.e., leno weave pattern 1300 may be the same on either side of mid-line 1370). In some embodiments, mid-line 1370 may be positioned such that it coincides with an upper mid-line when forming an upper for an article of footwear (e.g., upper mid-line 770 shown in FIG. 10). In embodiments having a leno weave pattern that is symmetrical about a mid-point, leno weave pattern may have multiple fold symmetry about the mid-point (e.g., two-fold or three-fold symmetry).

FIGS. 14A-14C show a perspective view of a foot with an illustration of skin temperatures, ranging from areas of highest temperature 1450, areas of high temperature 1460, and areas of medium temperature 1470 to areas with low temperatures 1480. View 1401 shows the skin temperature before an activity. View 1402 shows the skin temperature during an activity, and view 1403 finally shows the skin temperature after an activity. FIGS. 15A-15C show areas of strong sweat production 1504 of a foot in a lateral view 1501, a bottom view 1502, and top view 1503.

FIGS. 16A-16C illustrate a sock (or bootie) 1600 according to an embodiment. Sock 1600 includes specific zones corresponding to the areas of highest temperature and high temperature in FIGS. 14A-14C and areas of strong sweat production in FIGS. 15A-15C. A first zone 1610 with a higher degree of air permeability and a second zone 1620 with a higher degree of moisture wicking can be recognized in lateral view 1601, bottom view 1602 and top view 1603. First zone 1610 is arranged on the upper side of sock 1600 in the toe area (see lateral view 1601 and top view 1603) and on the lower side of sock 1600 in the toe area and in the area of the foot arch (see bottom view 1602). The second zone 1620 is arranged on the upper side of sock 1600 in the metatarsal area (see lateral view 1601 and top view 1603).

These zones of sock 1600 may correspond to zones of a shoe 1700 which is illustrated in FIGS. 17A-17C in a lateral view 1701, a bottom view 1702, and a top view 1703. Shoe 1700 may include a first zone 1710 with a higher degree of air permeability and a second zone 1720 with a higher degree of moisture wicking, which may be arranged in correspondence with the first and the second zones of sock 1600 from FIGS. 16A-16C. Sock 1600 in FIGS. 16A-16C and shoe 1700 in FIGS. 17A-17C may form a combined system for improved thermal regulation, as shown for example in FIGS. 18A-18C in a lateral view 1801, a bottom view 1802 and a top view 1803. In some embodiments, the zones of sock 1600 and shoe 1700 may be harmonized to provide one or more of the advantages described herein.

While various embodiments have been discussed herein in the context of footwear, other articles of appeal may be manufactured using the leno woven fabrics discussed herein (e.g., 200 and 810). Other articles of apparel include, but are not limited to, pants, shorts, leggings, a sock, a jacket, a coat, a hat, a sleeve, a shoe, a sweater, a jersey, a bootie, and a glove.

Some embodiments may include an article of footwear having a sole, an upper coupled to the sole, the upper including a leno woven fabric having a plurality of weft yarns extending in a substantially longitudinal direction from a forefoot portion of the article of footwear towards a heel portion of the article of footwear and a plurality of warp yarns extending in a transverse direction substantially perpendicular to the warp yarns, the leno woven fabric defining at least 50% of the upper.

In any of the various embodiments discussed herein, the leno woven fabric may occupy at least 50% of the outer surface area of an upper. In any of the various embodiments discussed herein, the leno woven fabric may be directly coupled to a sole of an article of footwear.

In any of the various embodiments discussed herein, the leno woven fabric may be a continuous fabric layer. In any of the various embodiments discussed herein, the leno woven fabric may be a continuous fabric layer having a portion extending from a forefoot portion of an article of footwear to a midfoot portion of an article of footwear. In any of the various embodiments discussed herein, the leno woven fabric may be a continuous layer having a portion extending from a forefoot portion of an article of footwear to a heel portion of an article of footwear. In any of the various embodiments discussed herein, the leno woven fabric may be a continuous layer having a portion extending from a lateral side of an article of footwear to a medial side of an article of footwear.

In any of the various embodiments discussed herein, an article of footwear may include one or more warp yarns having a first end directly coupled to the sole of an article of footwear and a second end directly coupled to the sole of an article of footwear. In any of the various embodiments discussed herein, an article of footwear may include one or more warp yarns having a first end directly coupled to a lateral side of the sole of an article of footwear and a second end directly coupled to a medial side of the sole of an article of footwear.

In any of the various embodiments discussed herein, the weft yarns may include at least one of: a moisture wicking yarn, an antibacterial yarn, a thermally conductive yarn, and combination thereof. In any of the various embodiments discussed herein, an article of footwear may include at least one weft yarn including a moisture wicking yarn and at least one other weft yarn including a thermally conductive yarn.

In any of the various embodiments discussed herein, an article of footwear may include a leno woven fabric that has a first strength in the longitudinal direction of the article of footwear and a second strength in the transverse direction of the article of footwear. In any of the various embodiments discussed herein, the first strength may be greater than the second strength.

In any of the various embodiments discussed herein, an article of footwear may include a leno woven fabric that has a first stretchability in the longitudinal direction of the article of footwear and a second stretchability in the transverse direction of the article of footwear. In any of the various embodiments discussed herein, the first stretchability may be greater than the second stretchability.

In any of the various embodiments discussed herein, the leno woven fabric may include a leno weave configuration having a non-uniform pattern. In any of the various embodiments discussed herein, the leno woven fabric may include a leno weave configuration having a non-uniform honeycomb pattern.

In any of the various embodiments discussed herein, an article of footwear may include an upper having a first portion including a leno woven fabric and a second portion. In any of the various embodiments discussed herein, the second portion may include a heel counter, an ankle cuff, and a tongue. In any of the various embodiments discussed herein, the second portion may be padded. In any of the various embodiments discussed herein, the second portion may be laminated to the leno woven fabric.

In any of the various embodiments discussed herein, an article of footwear may include one or more weft yarns having a first end coupled to the second portion and a second end coupled to the sole of the article of footwear. In any of the various embodiments discussed herein, all the weft yarns of an article of footwear may include a first end coupled to the second portion and a second end coupled to the sole of the article of footwear.

In any of the various embodiments discussed herein, the leno woven fabric may include one or more sets of at least two weft yarns extending from the second portion to the sole of the article of footwear and arranged side-by-side along at least a portion of an upper. In any of the various embodiments discussed herein, each weft yarn in a set of weft yarns may include a first end coupled to the second portion and a second end coupled to the sole of the article of footwear.

In any of the various embodiments discussed herein, a set of weft yarns may split at a first point on an upper and re-converge at a second point on the upper, thereby forming a weft yarn opening between the first point and the second point. In any of the various embodiments discussed herein, the weft yarn opening may have a honeycomb shape. In any of the various embodiments discussed herein, a weft yarn opening may be configured to provide at least one of: ventilation for an upper and directional stretchability for an upper. In any of the various embodiments discussed herein, a set of weft yarns may form more than one weft yarn opening. In any of the various embodiments discussed herein, a set of weft yarns may be an even numbered set of weft yarns.

In any of the various embodiments discussed herein, one or more sets of at least two weft yarns may be split at connection points between the weft yarns and at least one of: a sole and a second portion of an article of footwear. In any of the various embodiments discussed herein, weft yarns may be split by a warp yarn woven in between them.

In any of the various embodiments discussed herein, an article of footwear may include an upper including a textile layer coupled to a leno woven fabric. In any of the various embodiments discussed herein, the leno woven fabric may reinforce a textile layer.

In any of the various embodiments discussed herein, the leno woven fabric may be a single layer fabric material.

In any of the various embodiments discussed herein, the leno woven fabric may be a continuous layer having a portion extending from a toe box section of an upper to a vamp section of an upper. In any of the various embodiments discussed herein, the leno woven fabric may be a continuous layer having a portion extending from a toe box section of an upper to a quarter section of an upper. In any of the various embodiments discussed herein, the leno woven fabric may be a continuous layer having a portion extending from a vamp section of an upper to a quarter section of an upper.

Some embodiments may include an article of footwear including a sole, an upper coupled to the sole, the upper including a single layer woven fabric having a leno weave configuration including a plurality of weft yarns extending in a longitudinal direction from a forefoot portion of the article of footwear towards a heel portion of the article of footwear and a plurality of warp yarns extending in a transverse direction substantially perpendicular to the warp yarns.

In any of the various embodiments discussed herein, the single layer woven fabric may be directly coupled to the sole of an article of footwear. In any of the various embodiments discussed herein, the single layer woven fabric may include a continuous portion extending from a forefoot portion of an article of footwear to a midfoot portion of an article of footwear. In any of the various embodiments discussed herein, the single layer woven fabric may include a continuous portion extending from a forefoot portion of an article of footwear to a heel portion of an article of footwear. In any of the various embodiments discussed herein, the single layer woven fabric may include a continuous portion extending from a lateral side of an article of footwear to a medial side of an article of footwear.

In any of the various embodiments discussed herein, the single layer woven fabric may include one or more warp yarns with a first end directly coupled to a sole of an article of footwear and a second end directly coupled to the sole of the article of footwear. In any of the various embodiments discussed herein, the single layer woven fabric may include one or more warp yarns having a first end directly coupled to a lateral side of a sole and a second end directly coupled to a medial side of the sole.

In any of the various embodiments discussed herein, the single layer woven fabric may define at least 50% of an upper.

In any of the various embodiments discussed herein, the single layer woven fabric may have a first strength in the longitudinal direction of the article of footwear and a second strength in the transverse direction of the article of footwear. In any of the various embodiments discussed herein, the first strength may be greater than the second strength.

In any of the various embodiments discussed herein, the single layer woven fabric may have a first stretchability in the longitudinal direction of the article of footwear and a second stretchability in the transverse direction of the article of footwear. In any of the various embodiments discussed herein, the first stretchability may be greater than the second stretchability.

In any of the various embodiments discussed herein, an article of footwear may include weft yarns arranged in sets of at least two yarns arranged side-by-side along at least a portion of an upper. In any of the various embodiments discussed herein, a set of weft yarns may split at one or more points on the upper to provide at least one of: ventilation for the upper and directional stretchability for the upper.

In any of the various embodiments discussed herein, an article of footwear may include an upper having a first portion including a single layer woven fabric and a second portion including a heel counter, an ankle cuff, and a tongue. In any of the various embodiments discussed herein, the second portion may be laminated to the single layer woven fabric. In any of the various embodiments discussed herein, an article of footwear may include one or more weft yarns having a first end coupled to the second portion and a second end coupled to the sole of the article of footwear.

In any of the various embodiments discussed herein, the single layer woven fabric may be laminated to a sole of an article of footwear.

In any of the various embodiments discussed herein, the single layer woven fabric may be a continuous layer having a portion extending from a toe box section of an upper to a vamp section of an upper. In any of the various embodiments discussed herein, the single layer woven fabric may be a continuous layer having a portion extending from a toe box section of an upper to a quarter section of an upper. In any of the various embodiments discussed herein, the single layer woven fabric may be a continuous layer having a portion extending from a vamp section of an upper to a quarter section of an upper.

In any of the various embodiments discussed herein, the single layer woven fabric may be a continuous layer having varying degrees of at least one of: ventilation, thermal conductivity, stretchability, strength, moisture wicking, and antimicrobial protection.

Some embodiments include a method of manufacturing an article of footwear, the method including coupling a single layer woven fabric having a leno weave to a footwear component having a heel counter, coupling the single layer woven fabric to a sole, and coupling the heel counter to the sole.

In any of the various embodiments discussed herein, the single layer woven fabric may be laminated to at least one of: the footwear component and the sole. In any of the various embodiments discussed herein, the lamination may include high frequency welding.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. An article of footwear comprising:

a sole;

an upper coupled to the sole, the upper comprising:

a first portion comprising a single layer woven fabric comprising a lend weave configuration comprising a plurality of weft yarns extending in a longitudinal direction from a forefoot portion of the article of footwear towards a heel portion of the article of footwear and a plurality of warp yarns extending in a transverse direction substantially perpendicular to the warp yarns; and a second portion comprising a heel counter, wherein one or more weft yarns includes a first end coupled to the second portion and a second end coupled to the sole of the article of footwear.

2. The article of footwear of claim 1, wherein the single layer woven fabric is directly coupled to the sole.

3. The article of claim 1, wherein the single layer woven fabric includes a continuous portion extending from the forefoot portion of the article of footwear to a midfoot portion of the article of footwear.

4. The article of footwear of claim 1, wherein the single layer woven fabric includes a continuous portion extending from the forefoot portion of the article of footwear to the heel portion of the article of footwear.

5. The article of footwear of claim 1, wherein the single layer woven fabric includes a continuous portion extending from a lateral side of the article of footwear to a medial side of the article of footwear.

6. The article of footwear of claim 1, wherein one or more of the warp yarns includes a first end directly coupled to the sole and a second end directly coupled to the sole.

7. The article of footwear of claim 1, wherein one or more of the warp yarns includes a first end directly coupled to a lateral side of the sole and a second end directly coupled to a medial side of the sole.

8. The article of footwear of claim 1, wherein the single layer woven fabric defines at least 50% of the upper.

9. The article of footwear of claim 1, wherein the weft yarns comprise at least one of: a moisture wicking yarn, an antibacterial yarn, a thermally conductive yarn, and a combination thereof.

10. The article of footwear of claim 1, wherein the leno weave configuration comprises a non-uniform pattern.

11. The article of footwear of claim 1, wherein the leno weave configuration comprises a non-uniform honeycomb pattern.

12. The article of footwear of claim 1, wherein the weft yarns are arranged in sets of at least two yarns arranged side-by-side along at least a portion of the upper.

13. The article of footwear of claim 12, wherein the set of weft yarns splits at one or more points on the upper to provide at least one of: ventilation for the upper and directional stretchability for the upper.

14. The article of footwear of claim 1, wherein the second portion further comprises an ankle cuff and a tongue.

15. The article of footwear of claim 1, wherein the single layer woven fabric is a continuous layer having varying degrees of at least one of: ventilation, thermal conductivity, stretchability, strength, moisture wicking, and antimicrobial protection.

16. An article of footwear comprising:

a sole; and an upper coupled to the sole; the upper comprising a leno woven fabric comprising a plurality of weft yarns extending in a substantially longitudinal direction from a forefoot portion of the article of footwear towards a heel portion of the article of footwear and a plurality of warp yarns extending in a transverse direction substantially perpendicular to the warp yarns;

wherein the leno woven fabric comprises a continuous leno weave pattern extending from the forefoot portion of the upper to a midfoot portion of the upper, and wherein the continuous leno weave pattern comprises a pattern that varies a characteristic of the leno woven fabric by varying the spacing between at least one of the weft yarns and the warp yarns to provide targeted degrees of the characteristic to different areas in the forefoot portion and the midfoot portion of the upper.

17. The article of footwear of claim 16, wherein the leno woven fabric defines at least 50% of the outer surface area of the upper.

18. The article of footwear of claim 16, wherein the leno woven fabric is directly coupled to the sole.

19. A method of manufacturing an article of footwear, the method comprising:

coupling a single layer woven fabric to a footwear component comprising a heel counter, the single layer woven fabric comprising a lend weave configuration comprising a plurality of weft yarns extending in a longitudinal direction from a forefoot portion of the article of footwear towards a heel portion of the article of footwear and a plurality of warp yarns extending in a transverse direction substantially perpendicular to the warp yarns;

coupling the single layer woven fabric to a sole, wherein one or more weft yarns includes a first end coupled to the footwear component and a second end coupled to the sole; and coupling the heel counter to the sole.

20. The article of footwear of claim 16; wherein the characteristic is selected from the group consisting of: ventilation, thermal conductivity, stretchability, strength, moisture wicking, and antimicrobial protection.

* * * * *